US007771249B2

(12) United States Patent
Schlough et al.

(10) Patent No.: US 7,771,249 B2
(45) Date of Patent: Aug. 10, 2010

(54) CORNER SAW

(75) Inventors: Michael P. Schlough, St. Cloud, MN (US); Phillip A. Snartland, St. Cloud, MN (US); Aaron J. Zulkosky, St. Stephen, MN (US)

(73) Assignee: Park Industries, Inc., St. Cloud, MN (US)

( * ) Notice: Subject to any disclaimer, the term of this patent is extended or adjusted under 35 U.S.C. 154(b) by 443 days.

(21) Appl. No.: 11/731,724

(22) Filed: Mar. 30, 2007

(65) Prior Publication Data

US 2008/0236560 A1 Oct. 2, 2008

(51) Int. Cl.
*B24B 49/00* (2006.01)
*B24B 51/00* (2006.01)
*B24B 7/06* (2006.01)

(52) U.S. Cl. ..... 451/5; 125/13.01; 451/8; 451/65; 451/190; 451/194; 451/199

(58) Field of Classification Search ..... 125/13.01, 125/12; 451/190, 194, 199, 5, 8, 9, 10, 11, 451/65

See application file for complete search history.

(56) References Cited

U.S. PATENT DOCUMENTS

| | | | |
|---|---|---|---|
| 61,912 | A | 2/1867 | Yaman |
| 1,095,415 | A | 5/1914 | Parker |
| 1,263,461 | A | 4/1918 | Parker |
| 1,491,287 | A | 4/1924 | Canning |
| 1,765,890 | A | 6/1930 | Vates |
| 1,862,583 | A | 6/1932 | Skriba |
| 1,909,001 | A | 5/1933 | Nelson |
| 2,187,299 | A | 1/1940 | Burkhardt |
| 2,344,003 | A | 3/1944 | Sheptinsky |

(Continued)

FOREIGN PATENT DOCUMENTS

| | | | |
|---|---|---|---|
| CH | 657 806 | A5 | 9/1986 |

(Continued)

OTHER PUBLICATIONS

ACIMM News, 44 pages (Jul./Sep. 1999).

(Continued)

*Primary Examiner*—Timothy V Eley
(74) *Attorney, Agent, or Firm*—Merchant & Gould P.C.

(57) ABSTRACT

A cutting apparatus for cutting corner pieces formed of stone or other materials for use as building faces or for cutting flat pieces is disclosed herein. The cutting apparatus includes a frame with a first and a second conveyor operatively attached to the frame. The first and the second conveyors are configured to carry a workpiece from a first end of the frame to the second end of the frame. The first conveyor is disposed at an angle of about 45 degrees to a ground surface supporting the cutting apparatus. The second conveyor is disposed at an angle of about 45 degrees to the ground surface supporting the cutting apparatus, wherein the second conveyor is positioned perpendicularly to the first conveyor so as to form a V-shaped channel therewith. The cutting apparatus further includes a first cutting blade operatively attached to the frame and positioned generally parallel to the first conveyor and a second cutting blade operatively attached to the frame and positioned generally parallel to the second conveyor.

27 Claims, 12 Drawing Sheets

U.S. PATENT DOCUMENTS

| | | | | |
|---|---|---|---|---|
| 2,372,699 | A | | 4/1945 | Wiken et al. |
| 2,378,070 | A | | 6/1945 | Eastwood |
| 2,408,530 | A | | 10/1946 | Owen et al. |
| 2,444,598 | A | | 7/1948 | Eyles et al. |
| 2,450,371 | A | | 9/1948 | Coates |
| 2,455,113 | A | | 11/1948 | Coates |
| 2,460,386 | A | | 2/1949 | Hillquist |
| 2,557,251 | A | | 6/1951 | Baker et al. |
| 2,693,056 | A | | 11/1954 | Gagne |
| 2,708,332 | A | | 5/1955 | Riddell et al. |
| 2,716,402 | A | | 8/1955 | Harrison, Sr. et al. |
| 2,840,960 | A | | 7/1958 | Booth |
| 2,998,813 | A | | 9/1961 | Wilson |
| 3,127,886 | A | | 4/1964 | Miller |
| 3,136,098 | A | | 6/1964 | Backer |
| 3,289,662 | A | | 12/1966 | Garrison |
| 3,483,858 | A | | 12/1969 | Jansen |
| 3,491,807 | A | | 1/1970 | Underwood |
| 3,534,789 | A | | 10/1970 | Morris |
| 3,547,096 | A | | 12/1970 | Ronzani |
| 3,575,075 | A | | 4/1971 | Fisher |
| 3,634,975 | A | | 1/1972 | Hensley |
| 3,690,356 | A | | 9/1972 | Holan |
| 3,722,496 | A | | 3/1973 | Schuman |
| 3,738,349 | A | | 6/1973 | Cooper et al. |
| 3,748,789 | A | | 7/1973 | Wada et al. |
| 3,761,675 | A | | 9/1973 | Mason et al. |
| 3,776,072 | A | | 12/1973 | Gerber et al. |
| 3,877,334 | A | | 4/1975 | Gerber |
| 3,896,783 | A | | 7/1975 | Manning |
| 3,960,407 | A | | 6/1976 | Noren |
| 4,031,933 | A | | 6/1977 | Piche |
| 4,033,319 | A | | 7/1977 | Winter |
| 4,074,858 | A | | 2/1978 | Burns et al. |
| 4,107,883 | A | | 8/1978 | Bein |
| 4,112,797 | A | | 9/1978 | Pearl |
| 4,131,103 | A | | 12/1978 | Ishizuka |
| 4,176,883 | A | | 12/1979 | Liesveld |
| 4,204,448 | A | | 5/1980 | Pearl |
| 4,244,102 | A | | 1/1981 | Bolles |
| 4,280,735 | A | | 7/1981 | Löbbe |
| 4,290,496 | A | | 9/1981 | Briggs |
| 4,309,600 | A | | 1/1982 | Perry et al. |
| 4,312,254 | A | | 1/1982 | Pearl |
| 4,372,174 | A | | 2/1983 | Cymbalisty et al. |
| 4,409,875 | A | * | 10/1983 | Nakajima et al. ..... 83/877 |
| 4,436,078 | A | | 3/1984 | Bourke |
| 4,446,845 | A | | 5/1984 | Harding |
| 4,555,143 | A | | 11/1985 | Wrulich et al. |
| 4,559,920 | A | | 12/1985 | Toncelli et al. |
| 4,570,609 | A | | 2/1986 | Hogue |
| 4,597,225 | A | | 7/1986 | Toncelli |
| 4,607,792 | A | | 8/1986 | Young, III |
| 4,619,163 | A | | 10/1986 | Brown |
| 4,620,525 | A | | 11/1986 | Toncelli |
| 4,660,539 | A | | 4/1987 | Battaglia |
| 4,663,893 | A | | 5/1987 | Savanick et al. |
| 4,738,218 | A | | 4/1988 | Toncelli |
| 4,741,577 | A | | 5/1988 | Sato et al. |
| 4,782,591 | A | | 11/1988 | DeVito et al. |
| 4,794,964 | A | | 1/1989 | Wolf |
| 4,838,968 | A | | 6/1989 | Nelson |
| 4,870,946 | A | | 10/1989 | Long et al. |
| 4,920,947 | A | | 5/1990 | Scott et al. |
| 4,924,843 | A | | 5/1990 | Waren |
| 4,940,038 | A | | 7/1990 | O'Keefe |
| 4,969,380 | A | | 11/1990 | Halligan |
| 5,003,729 | A | | 4/1991 | Sherby |
| 5,022,193 | A | | 6/1991 | Toncelli |
| 5,080,085 | A | | 1/1992 | Lovato |
| 5,085,008 | A | | 2/1992 | Jennings et al. |
| 5,127,391 | A | | 7/1992 | O'Keefe |
| 5,189,939 | A | | 3/1993 | Allen, Jr. |
| 5,191,873 | A | | 3/1993 | Browning et al. |
| 5,269,211 | A | | 12/1993 | Flaming |
| 5,291,694 | A | | 3/1994 | Hosoya et al. |
| 5,302,228 | A | | 4/1994 | Holland |
| 5,332,293 | A | | 7/1994 | Higgins et al. |
| 5,338,179 | A | | 8/1994 | Luca |
| 5,349,788 | A | | 9/1994 | Nedo et al. |
| 5,411,432 | A | | 5/1995 | Wyatt et al. |
| 5,435,951 | A | | 7/1995 | Toncelli |
| 5,472,367 | A | | 12/1995 | Slocum et al. |
| 5,575,538 | A | | 11/1996 | Gilbert et al. |
| 5,595,170 | A | | 1/1997 | Lupi |
| 5,635,086 | A | | 6/1997 | Warren, Jr. et al. |
| 5,690,092 | A | | 11/1997 | Ogyu |
| 5,720,648 | A | | 2/1998 | Green et al. |
| 5,782,673 | A | | 7/1998 | Warehime |
| 5,802,939 | A | | 9/1998 | Wiand et al. |
| 5,868,056 | A | | 2/1999 | Pfarr et al. |
| 5,921,228 | A | | 7/1999 | Watson |
| 5,934,346 | A | | 8/1999 | Windeisen et al. |
| 6,000,387 | A | | 12/1999 | Lee |
| 6,006,735 | A | | 12/1999 | Schlough et al. |
| 6,068,547 | A | | 5/2000 | Lupi |
| 6,073,621 | A | | 6/2000 | Cetrangolo |
| 6,102,023 | A | * | 8/2000 | Ishiwata et al. ..... 125/13.01 |
| 6,131,557 | A | | 10/2000 | Watson |
| 6,152,127 | A | | 11/2000 | Fuhrman et al. |
| 6,152,804 | A | | 11/2000 | Okuyama |
| 6,155,245 | A | | 12/2000 | Zanzuri |
| 6,170,478 | B1 | | 1/2001 | Gorder |
| 6,186,136 | B1 | | 2/2001 | Osborne |
| 6,222,155 | B1 | | 4/2001 | Blackmon et al. |
| 6,263,866 | B1 | | 7/2001 | Tsao |
| 6,306,015 | B1 | | 10/2001 | Bushell |
| 6,318,351 | B1 | | 11/2001 | Baratta |
| 6,361,404 | B1 | | 3/2002 | Ishiwata et al. |
| 6,371,103 | B1 | | 4/2002 | Lupi |
| 6,375,558 | B1 | | 4/2002 | Baratta |
| 6,427,677 | B1 | | 8/2002 | O'Banion et al. |
| 6,439,218 | B1 | | 8/2002 | Hulett |
| 6,457,468 | B1 | | 10/2002 | Goldberg |
| 6,547,337 | B2 | | 4/2003 | Welch, Jr. |
| 6,550,544 | B1 | | 4/2003 | Saf |
| 6,561,287 | B2 | | 5/2003 | DeBlasio |
| 6,561,786 | B2 | | 5/2003 | Ciccarello |
| 6,595,196 | B2 | | 7/2003 | Bath |
| 6,598,597 | B1 | | 7/2003 | Marocco et al. |
| 6,612,212 | B1 | | 9/2003 | Wiand et al. |
| 6,637,424 | B1 | | 10/2003 | Fuhrman et al. |
| 6,659,099 | B2 | | 12/2003 | Holmes |
| 6,691,695 | B2 | | 2/2004 | Buechel |
| 6,752,140 | B1 | | 6/2004 | Fuhrman et al. |
| 6,945,858 | B1 | | 9/2005 | Holmes |
| 7,056,188 | B1 | | 6/2006 | Triplett et al. |
| 7,121,920 | B1 | | 10/2006 | Triplett et al. |
| 7,232,361 | B1 | | 6/2007 | Triplett et al. |
| 2002/0148651 | A1 | | 10/2002 | DeBlasio |
| 2003/0092364 | A1 | | 5/2003 | Erickson et al. |
| 2003/0127484 | A1 | | 7/2003 | Wirsam |
| 2003/0131839 | A1 | | 7/2003 | Steiner et al. |
| 2003/0145699 | A1 | | 8/2003 | Kim et al. |
| 2003/0168054 | A1 | | 9/2003 | Governo et al. |
| 2003/0172916 | A1 | | 9/2003 | Buechel |
| 2003/0172917 | A1 | | 9/2003 | Baratta |
| 2003/0188893 | A1 | | 10/2003 | DeBlasio |
| 2003/0202091 | A1 | | 10/2003 | Garcia et al. |
| 2004/0007225 | A1 | | 1/2004 | Baratta |
| 2004/0007226 | A1 | | 1/2004 | Denys |
| 2004/0112358 | A1 | | 6/2004 | Dossena et al. |
| 2004/0129261 | A1 | | 7/2004 | Baratta |
| 2004/0187856 | A1 | | 9/2004 | Schlough et al. |

| | | | |
|---|---|---|---|
| 2004/0206345 | A9 | 10/2004 | Baratta |
| 2005/0147806 | A1 | 7/2005 | Toncelli et al. |
| 2005/0247003 | A1 | 11/2005 | Holmes |
| 2006/0084364 | A1 | 4/2006 | Toncelli |
| 2006/0135041 | A1 | 6/2006 | Boone et al. |

FOREIGN PATENT DOCUMENTS

| | | | |
|---|---|---|---|
| CH | 658 221 | A5 | 10/1986 |
| CH | 677 897 | A5 | 7/1991 |
| CN | 1047643 | A | 12/1990 |
| DE | 33 32 051 | A1 | 3/1984 |
| DE | 40 21 302 | A1 | 1/1992 |
| DE | 41 02 607 | A1 | 10/1992 |
| DE | 43 08 580 | A1 | 9/1994 |
| DE | 43 32 630 | A1 | 3/1995 |
| DE | 196 03 933 | A1 | 8/1997 |
| DE | 197 10 425 | A1 | 9/1998 |
| EP | 0 062 953 | A2 | 10/1982 |
| EP | 0 142 570 | A1 | 5/1985 |
| EP | 0 517 048 | A1 | 12/1992 |
| EP | 0 684 340 | A1 | 11/1995 |
| EP | 0 517 048 | B1 | 10/1996 |
| EP | 0 684 340 | B1 | 1/2000 |
| EP | 1 125 706 | A2 | 8/2001 |
| EP | 1 136 215 | A2 | 9/2001 |
| EP | 1 415 780 | A2 | 5/2004 |
| FR | 517.397 | | 5/1921 |
| FR | 1.104.039 | | 11/1955 |
| FR | 2.111.813 | | 6/1972 |
| FR | 2 548 073 | A1 | 1/1985 |
| FR | 2 644 723 | A1 | 9/1990 |
| GB | 842982 | | 8/1960 |
| GB | 880892 | | 10/1961 |
| GB | 2 125 850 | A | 3/1984 |
| JP | 52-16091 | | 2/1977 |
| JP | 55-125417 | | 9/1980 |
| JP | 60-92404 | | 5/1985 |
| JP | 60-162602 | | 8/1985 |
| JP | 60-167744 | | 8/1985 |
| JP | 1-252376 | | 10/1989 |
| JP | 5-185421 | | 7/1993 |
| JP | 6-63934 | | 3/1994 |
| JP | 6-155448 | | 6/1994 |
| JP | 6-270138 | | 9/1994 |
| JP | 6-297449 | | 10/1994 |
| JP | 7-1441 | | 1/1995 |
| JP | 2003-314998 | | 11/2003 |
| WO | WO 2005/014252 | A1 | 2/2005 |
| WO | WO 2006/043294 | A1 | 4/2006 |
| WO | WO 2008/002291 | A1 | 1/2008 |

OTHER PUBLICATIONS

Advanced Stone Technologies, Breton S.p.A., 12 pages (Admitted as prior art as of Mar. 16, 2007).
Automatic Block Cutting Machine DBC Series SBC Series, Wuuhersin Machinery Manufactory Co., Ltd., 6 pages (Admitted as prior art as of Mar. 16, 2007).
Automatic Bridge Saw "Teorema 35", Blandini S.r.l., 5 pages (Dec. 10, 2000).
Block Cutting Machine for Granite, Barsanti Macchine, 1 page (Admitted as prior art as of Mar. 16, 2007).
Bufalo-M, Gregori S.p.A., 12 pages (Admitted as prior art as of Mar. 16, 2007).
Combicut DJ/NC 2 in 1, Breton S.p.A., 1 page (Admitted as prior art as of Mar. 16, 2007).
Combicut DJ/NC, Breton S.p.A., ISO 9001:2000, Cert. N. 0056, 1 page (Admitted as prior art as of Mar. 16, 2007).
Drastically increase the production of your CNC Machine!, High Tech Stone, Inc., 1 page (Admitted as prior art as of Mar. 16, 2007).
Eagle—Traveling Bridge Diamond Saw, Park Industries, Inc., 2 pages (Admitted as prior art as of Mar. 16, 2007).
Fresa A Ponte Bridge Milling Machine, Strathesys 80/35, Blandini S.r.l., 4 pages (Admitted as prior art as of Mar. 16, 2007).
Fresatrice Automatica A Ponte, Blandini S.r.l., 4 pages (Admitted as prior art as of Mar. 16, 2007).
Jaguar—Gantry Diamond Saw, Park Industries, Inc., 2 pages (Admitted as prior art as of Mar. 16, 2007).
Joycut FS/NC 500, Breton, S.p.A., 5 pages (2006).
Machines for Everyone, Machines for Everything., Pedrini, 18 pages (Admitted as prior art as of Mar. 16, 2007).
Marble Technologies, BV Bombieri & Venturi, pp. 1-7 (Admitted as prior art as of Mar. 16, 2007).
Mod. MAYA—rifilatrici/trimming machine, Zomato, 4 pages (May 1992).
Northwood Stoneworks, http://www.northwoodstoneworks.com, Northwood Machine Manufacturing Company, 3 pages (Copyright 2004).
Precision Sawing and Polishing Machinery for Today's Indsutry, Sawing Systems Inc., pp. 1-19 (Admitted as prior art as of Mar. 16, 2007).
Precision Sawing and Polishing Machinery for Today's Industry, Sawing Systems Incorporated, pp. 1-27 (Admitted as prior art as of Mar. 16, 2007).
Predator—Traveling Bridge Diamond Saw, Park Industries, 2 pages (Admitted as prior art as of Mar. 16, 2007).
Python—Traveling Bridge Diamond Saw, Park Industries, 2 pages (Admitted as prior art as of Mar. 16, 2007).
S4C Hydraulic Block-Cutter with Uprights, Officine Meccaniche F.LLI Zambon S.N.C., 8 pages (Admitted as prior art as of Mar. 16, 2007).
SawJET™ Technology, http://www.northwoodstoneworks.com/SawJETS.html, Northwood Machine Manufacturing Company, 5 pages (Copyright 2006).
SIMEC Book General Catalogue Stone, SIMEC S.p.A., pp. 1-50 (Admitted as prior art as of Mar. 16, 2007).
Speedycut FK/NC 1100, Breton S.p.A.,ISO 9001:2000, Cert. N. 0056, 16 pages (Admitted as prior art as of Mar. 16, 2007).
Spiderbreton FRPC 700/1200, Breton S.p.A., ISO 9001, Cert. N. 0056, 6 pages (Admitted as prior art as of Mar. 16, 2007).
Stone, pp. 1-54 (Feb. 1993).
StoneJET—The Only with Bridge Sawing and Water JET, 1 page (Admitted as prior art as of Mar. 16, 2007).
Taormina "2", Officina Meccanica Antonino Mantello, 2 pages (Admitted as prior art as of Mar. 16, 2007).
Sawing Systems Incorporated, Catalog—"Precision Sawing and Polishing Machinery for Today's Industry," Admitted as Prior Art: Mar. 30, 2007, 28 Pages.
Sawing Systems Incorporated, Ad —"The Source for Quality Sawing, Routing and Polishing Equipment," Mar. 2005, 1 Page.

* cited by examiner

CORNER SAW

TECHNICAL FIELD

The present disclosure relates generally to an apparatus for cutting/shaping various materials including stone and other materials. More particularly, the present disclosure relates to an apparatus for cutting corner pieces formed of stone or other materials for use as building faces.

BACKGROUND

Saws for cutting stone and similar materials are known in the art. Stone may be laid as a structural component or as an aesthetic cladding or veneer on houses, buildings, walls, flooring, etc. There is a demand for corner pieces of facing stone that can be placed on the corner of a building such as a house. Preferably, the corner pieces have an interior corner cut into the stone so that the stone can be placed on the outside corner of a building, giving the appearance of stone construction.

A clean finished product is important to the appearance of the corner piece. Many of the prior art corner cutting systems do not provide the stability needed during the cutting process for a clean, precise cut of the corner in the stone. Some prior art methods include cutting corner pieces by hand using free-standing rock saws, resulting in unwanted spoilage and requiring saw operators to work in close proximity to an exposed blade.

Improvements in corner cutting systems are desired.

SUMMARY

One aspect of the present disclosure relates to an apparatus for cutting stone and other various materials including two conveyor structures arranged at a right angle to each other and two cutting blades arranged at right angles to each other wherein the distances between the cutting blades and the surfaces of the conveyor structures may correspond to the thickness of respective stone walls forming a corner piece. The cutting apparatus may also be used to cut flat workpieces by using a single blade.

In one example embodiment, the cutting apparatus includes a frame with a first and a second conveyor operatively attached to the frame. The first and the second conveyors are configured to carry a workpiece from a first end of the frame to the second end of the frame. The first conveyor is disposed at an angle of about 45 degrees to a ground surface supporting the cutting apparatus. The second conveyor is disposed at an angle of about 45 degrees to the ground surface supporting the cutting apparatus, wherein the second conveyor is positioned perpendicularly to the first conveyor belt so as to form a V-shaped channel therewith. The cutting apparatus further includes a first cutting blade operatively attached to the frame and positioned generally parallel to the first conveyor and a second cutting blade operatively attached to the frame and positioned generally parallel to the second conveyor.

Examples representative of a variety of inventive aspects are set forth in the description that follows. The inventive aspects relate to individual features as well as combinations of features. It is to be understood that both the forgoing general description and the following detailed description merely provide examples of how the inventive aspects may be put into practice, and are not intended to limit the broad spirit and scope of the inventive aspects.

DETAILED DESCRIPTION

FIGS. 1-10 illustrate a cutting apparatus 10 in accordance with the principles of the present disclosure. According to one embodiment, the cutting apparatus 10 is configured for cutting corner pieces of facing stone or other materials that can be placed on the corner of a building for aesthetic purposes. When cut as such, the pieces include an interior corner cut into the stone so that the stone can be placed on the outside corner of a building, giving the appearance of stone construction. It should be noted that the apparatus 10 of the present disclosure is not limited to machining of stone and similar materials such as granite and marble, and, that other materials may be machined using the apparatus 10.

Figure 7:
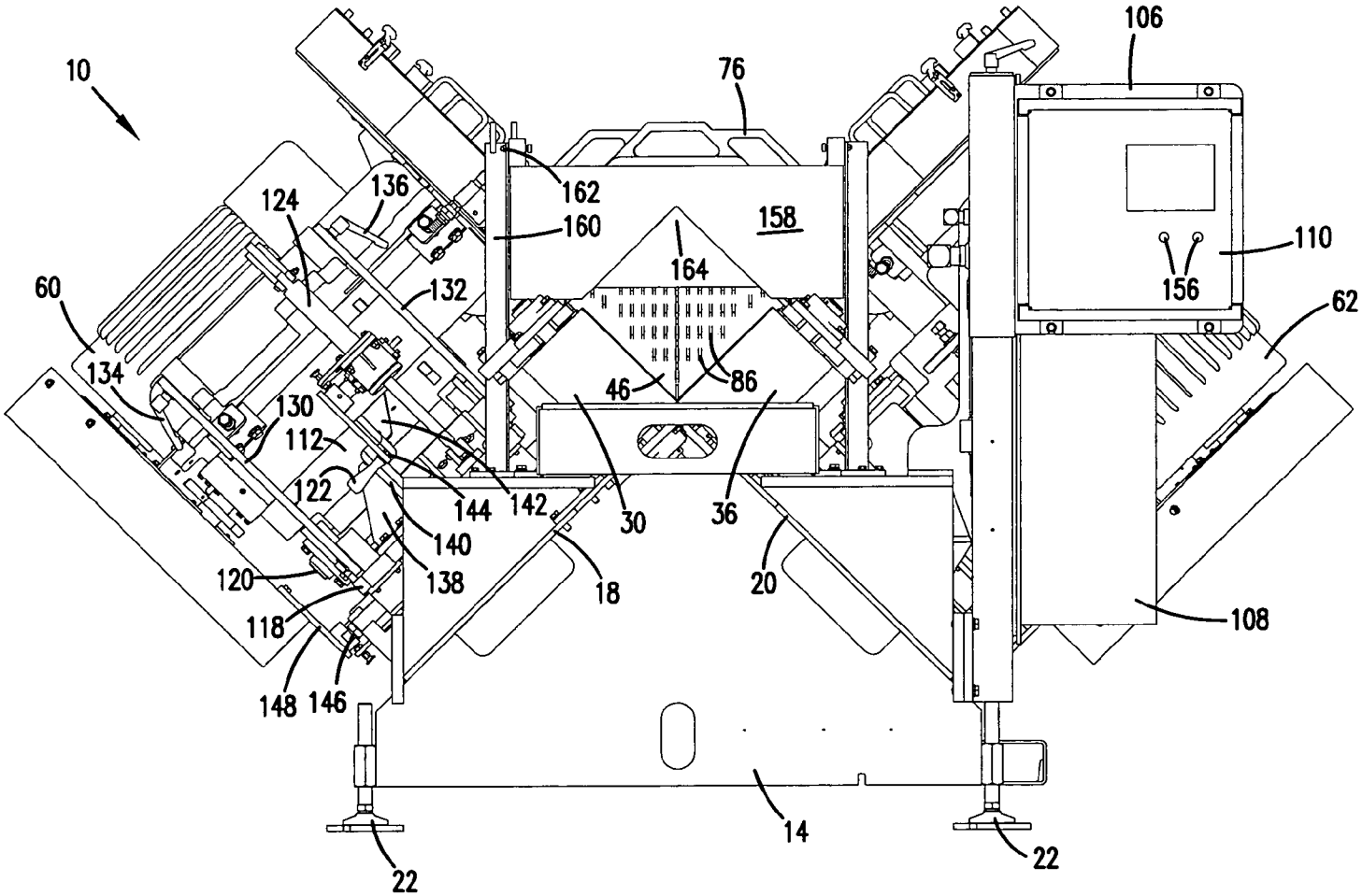
FIG. 7 is a front view of the cutting apparatus of FIG. 1.
Figure 8:
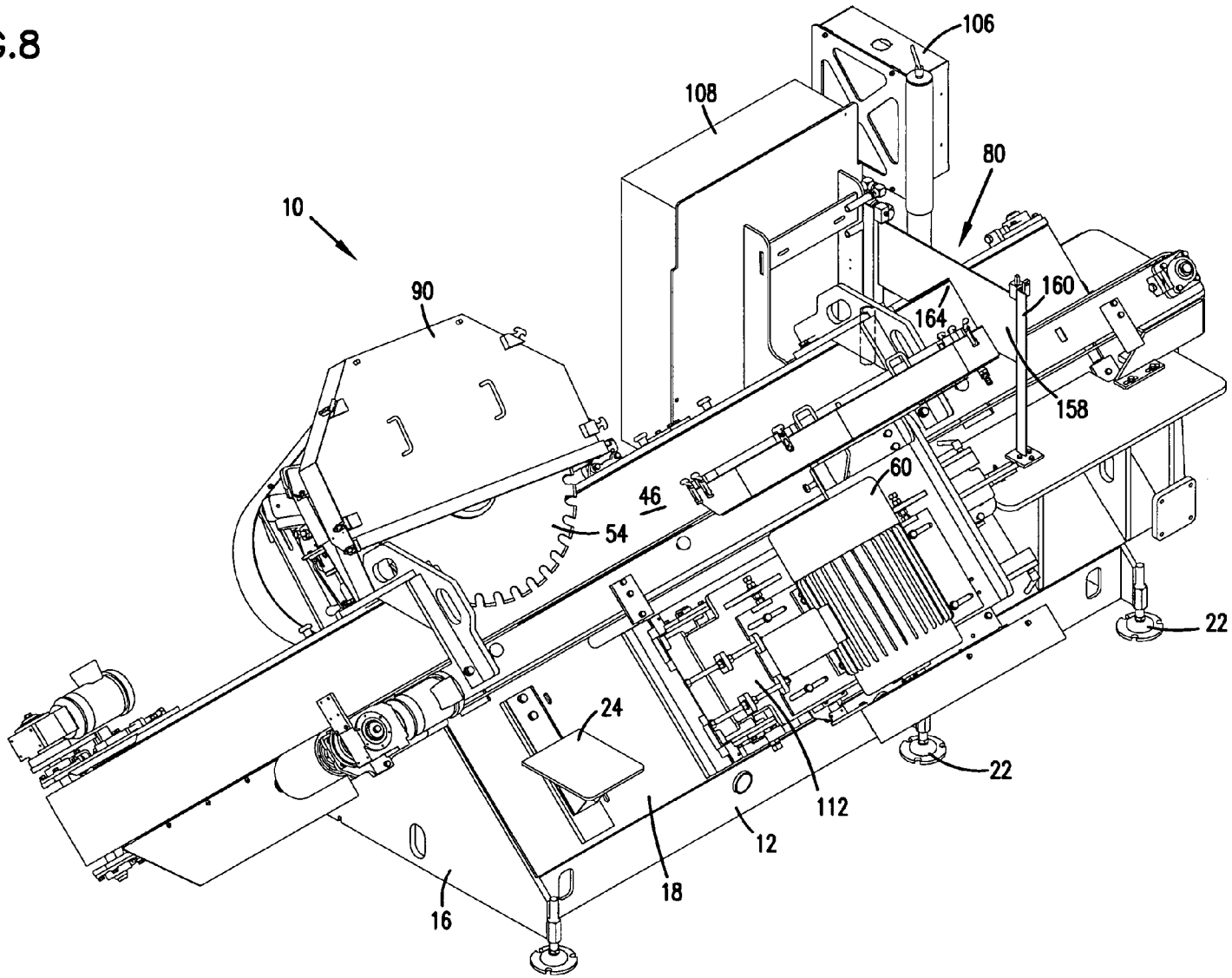
FIG. 8 is a rear, left perspective view of the cutting apparatus of FIG. 1, shown without the channel cover.
Figure 9:
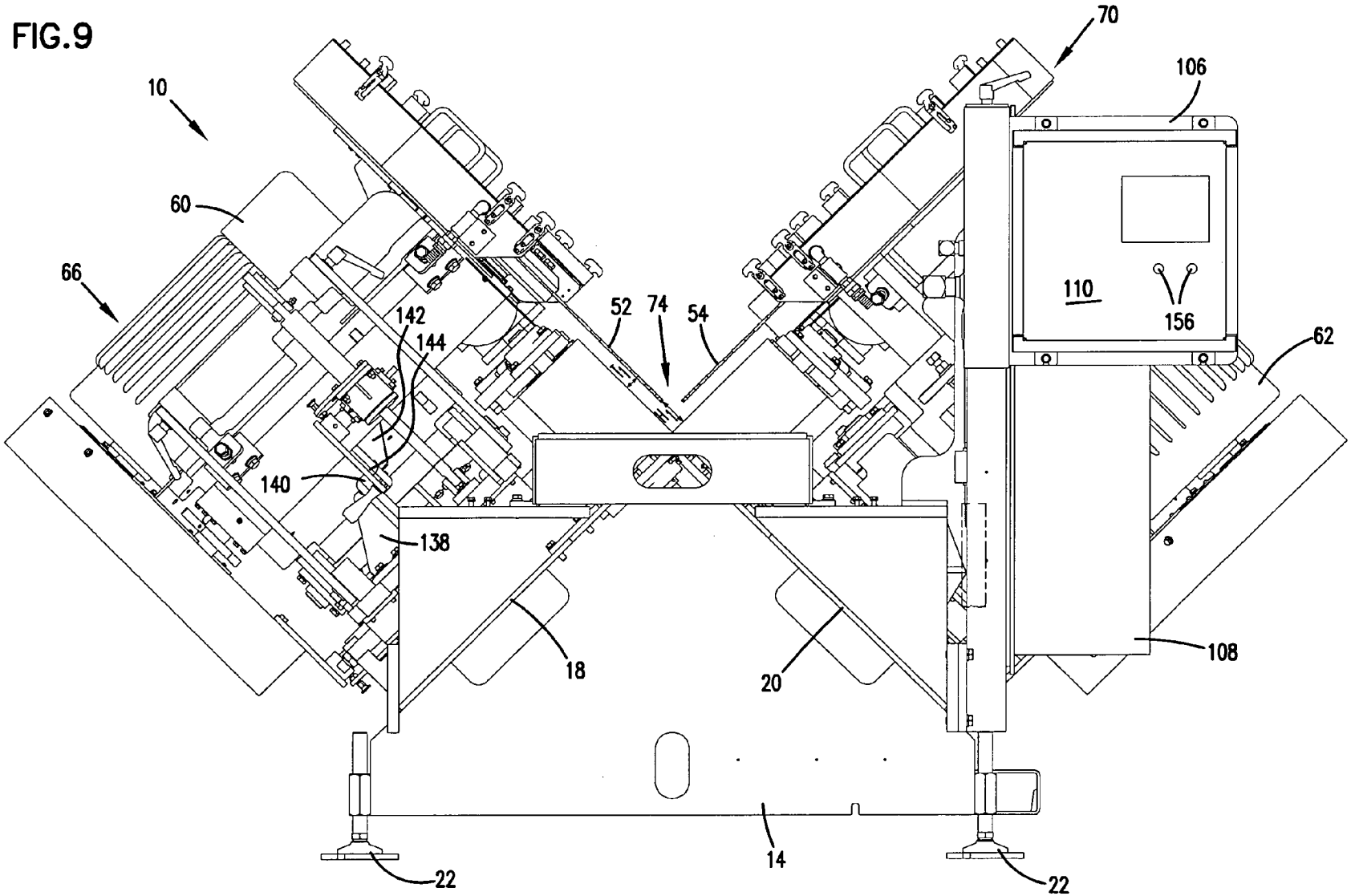
FIG. 9 is a front view of the cutting apparatus of FIG. 8.

Referring now to FIGS. 1-9, the cutting apparatus 10 includes a frame 12 including a front plate 14, a rear plate 16 and a pair of longitudinal plates 18, 20 extending between the front plate 14 and the rear plate 16. As shown in FIGS. 7 and 9, the longitudinal plates 18, 20 are positioned at a perpendicular angle with respect to each other and form a 45° angle with respect to the ground surface, defining a generally triangular configuration. The frame 12 is supported on a ground surface with height-adjustable footings 22.

Various features of the cutting apparatus 10 are fastened to the longitudinal plates 18, 20, as will be described in further detail below. For example, according to the depicted embodiment, the longitudinal plates 18, 20 of the frame 12 include step structures 24 fastened thereto for the operators of the cutting apparatus 10 to step on.

Still referring to FIGS. 1-9, the cutting apparatus 10 includes a first conveyor assembly 26 and a second conveyor assembly 28 fastened thereto and supported by the frame 12. The first conveyor assembly 26 includes a first conveyor belt 30 driven on first and second conveyor rollers 32, 34 (i.e., conveyor pulleys). The second conveyor assembly 28 includes a second conveyor belt 36 driven on third and fourth conveyor rollers 38, 40 (i.e., conveyor pulleys). The first and second conveyor rollers 32, 34 include a pair of first conveyor plates 42 extending therebetween, supporting the rollers 32, 34. The third and fourth conveyor rollers 38, 40 include a pair of second conveyor plates 44 extending therebetween, supporting the rollers 38, 40. The conveyor plates 42, 44 are fastened to the longitudinal plates 18, 20 of the frame 12 to connect the conveyor assemblies 26, 28 to the cutting apparatus 10. The first conveyor belt 30 is arranged perpendicularly to the second conveyor belt 36, forming a V-shaped channel 46 therewith (see FIGS. 7 and 9). The first and the second conveyor belts 30, 36 extend generally from the front end 48 of the cutting apparatus 10 to the rear end 50. It should be noted that the cutting apparatus of the present disclosure is not limited to the use of conveyor belts for moving a workpiece (e.g., a piece of stone to be cut into a corner piece) from one end of the cutting apparatus to the other end in the longitudinal direction. Although the embodiment depicted is shown as using conveyor belts, other types of conveying structures can be used to transport the workpieces.

Figure 4:
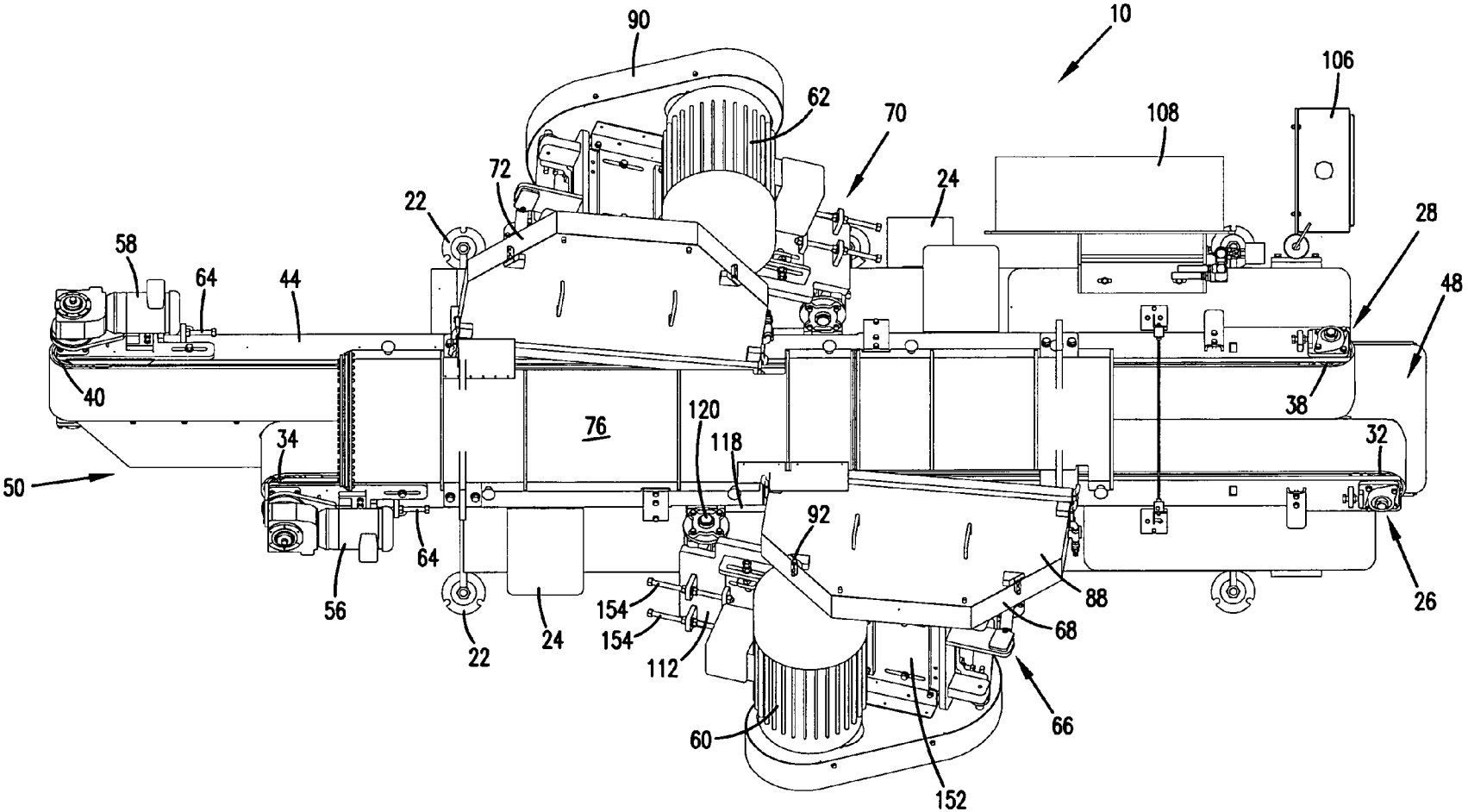
FIG. 4 is a top plan view of the cutting apparatus of FIG. 1.
Figure 5:
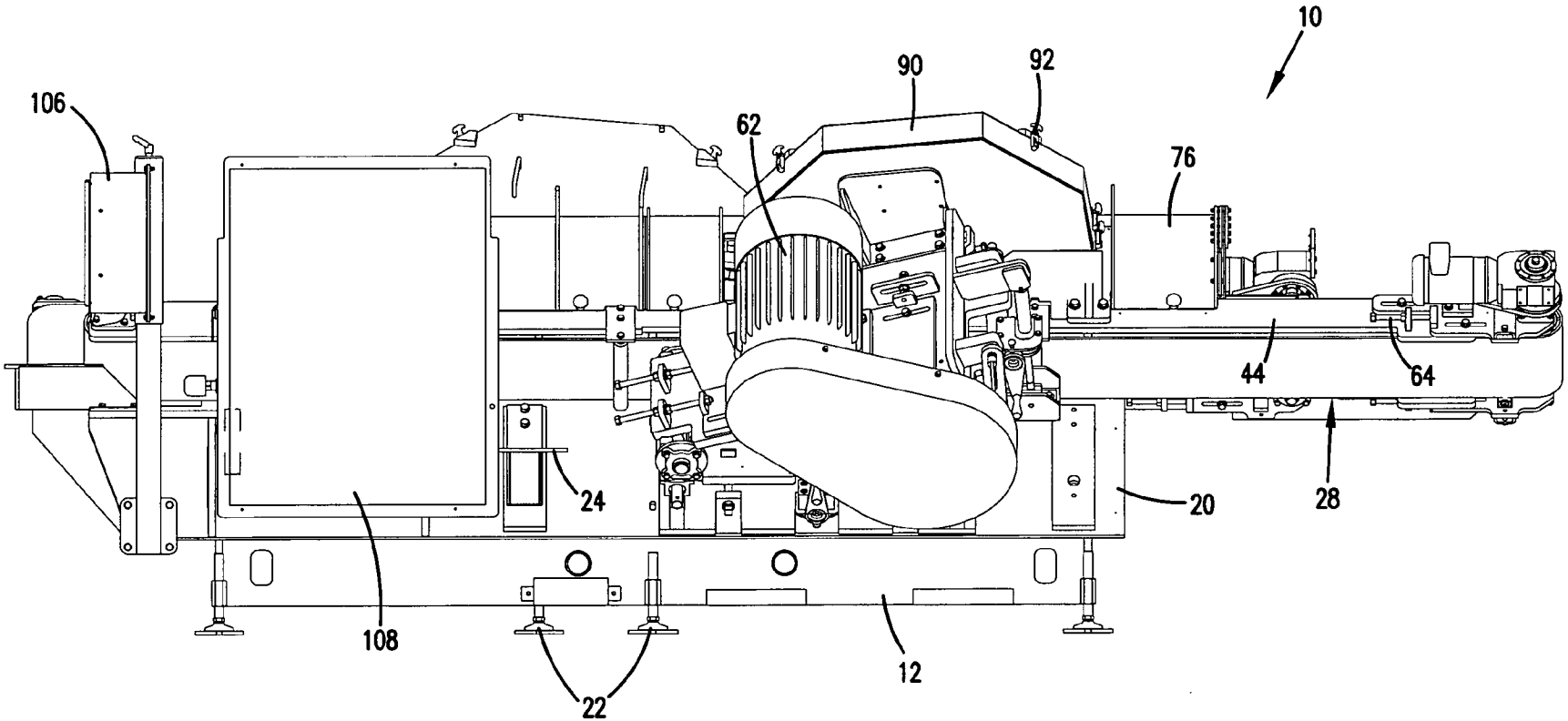
FIG. 5 is a right side elevational view of the cutting apparatus of FIG. 1.
Figure 6:
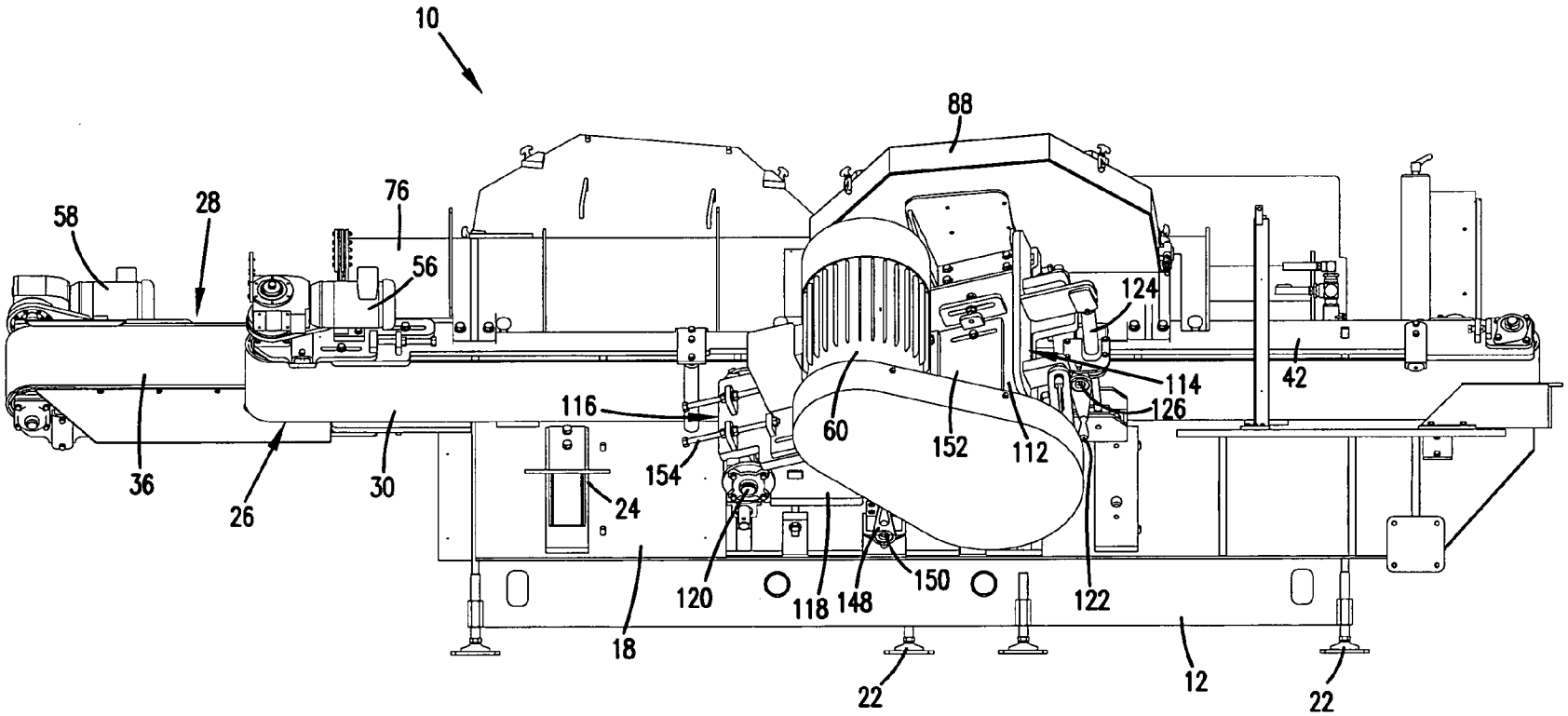
FIG. 6 is a left side elevational view of the cutting apparatus of FIG. 1.

As shown in FIG. 4, the second conveyor assembly 28 is offset with respect to the first conveyor assembly 26 adjacent the front end 48 of the cutting apparatus 10. Adjacent the rear end 50 of the cutting apparatus 10, the second conveyor assembly 28 is offset with respect to the first conveyor assembly 26 and extends farther back from the rear end 50. The first and second conveyor belts 30, 36 are configured to carry a workpiece from the front end 48 of the cutting apparatus 10, past cutting blades 52, 54 of the apparatus 10, to the rear end 50 of the cutting apparatus 10. The second conveyor assembly 28 is arranged offset to the first conveyor assembly 26 at the rear end 50 such that workpieces can be unloaded toward one side (e.g., the left side) of the cutting apparatus 10 after having been cut.

It should be noted that the cutting apparatus 10 of the present disclosure can be used to cut a plurality of workpieces as part of an ongoing cutting operation. The workpieces can be loaded into the V-shaped channel 46 in series and can be cut one after another in the order loaded.

The second roller 34 of the first conveyor assembly 26 is operatively coupled to and driven by a first conveyor motor assembly 55. The fourth roller 40 of the second conveyor assembly 28 is operatively coupled to and driven by a second conveyor motor assembly 57. In one embodiment, the conveyor motor assemblies 55, 57 include a first conveyor motor 56 and a second conveyor motor 58, respectively, and, a gearbox associated with each conveyor motor assembly. In certain embodiments, the conveyor motors may be 0.5 HP motors. The motors may be induction or electric motors. In the depicted embodiment herein, the rollers 34, 40 are coupled to the conveyor motors 56, 58 via the gear boxes (i.e., gear systems), as is known in the art. According to one embodiment of the cutting apparatus 10, the conveyor motors 56, 58 are electronically controlled such that the speeds of the first conveyor belt 30 and the second conveyor belt 36 are equal to each other during a cutting operation. According to one embodiment, the cutting apparatus 10 is configured such that the speed of the conveyor belts 30, 36 is adjusted according to loads encountered on the first and second blade motors 60, 62, as will be described in further detail below.

The tension of each conveyor belt 30, 36 is adjustable via belt adjustment screws 64. The conveyor motor assemblies 55, 57 and the conveyor pulleys 34, 40 may be moved with respect to the conveyor belts 30, 36 via the belt adjustment screws 64 to loosen or tighten the tension of the conveyor belts 30, 36. The tension of the belts 30, 36 can be loosened and the belts 30, 36 removed from the conveyor assemblies 26, 28 for replacement purposes. In one embodiment, the conveyor belt adjustment screws 64 may be hand operated.

Still referring to FIGS. 1-9, the cutting apparatus 10 includes a first carriage 66 carrying a first blade assembly 68 and a second carriage 70 carrying a second blade assembly 72. The first carriage 66 is fastened thereto and supported by the left longitudinal plate 18 of the frame 12 and the second carriage 70 is fastened thereto and supported by the right longitudinal plate 20 of the frame 12. The first blade assembly 68 includes the first blade 52 arranged parallel to the first conveyor belt 30 and arranged perpendicular to the second conveyor belt 36. The second blade assembly 72 of the cutting apparatus 10 includes the second blade 54 arranged parallel to the second conveyor belt 36 and arranged perpendicular to the first conveyor belt 30.

As shown in FIG. 4, the first blade 52 is located closer to the front end 48 of the cutting apparatus 10 than the second blade 54 (i.e., upstream of the second blade). In one embodiment, the centerline-to-centerline distance D of the blades 52, 54 is about 50 inches along the channel 46. In one embodiment, the diameter of each of the blades 52, 54 is about 40 inches. It should be noted that the sizes, types, and rotational speeds of the blades 52, 54 may be changed depending upon the type of material being cut. As shown in FIG. 7, the first blade 52 and the second blade 54 are arranged perpendicular to the each other, forming a V-shaped arrangement 74, as in the conveyor belts 30, 36.

The first blade 52 is configured to cut one side of a corner piece formed from the workpiece while the second blade 54 is configured to cut the other perpendicular side of the corner piece to be formed from the workpiece, as the workpiece is moved along the channel 46 by the conveyor belts 30, 36. The first carriage 66 is movably coupled to the frame 12 of the cutting apparatus 10. In this manner, the first blade 52 can be moved toward and away from the first conveyor belt 30 to adjust the thickness $T_1$ of the side of the corner piece to be cut by the first blade 52. The first blade 52 is also movable toward and away from the second conveyor belt 36 to adjust the height $H_1$ of the side of the corner piece to be cut by the first blade 52. Similarly, the second carriage 70 is movably coupled to the frame 12 of the cutting apparatus 10. The second blade 54 can be moved toward and away from the second conveyor belt 36 to adjust the thickness $T_2$ of the side of the corner piece to be cut by the second blade 54. The second blade 54 is also movable toward and away from the first conveyor belt 30 to adjust the height $H_2$ of the side of the corner piece to be cut by the second blade 54. The thickness $T_1$ and the height $H_1$ of a side of the corner piece to be cut by the first blade 52 are illustrated in FIG. 9.

The first blade 52 is operated by the first blade motor 60 that is fastened to the first carriage 66 and the second blade 54 is operated by the second blade motor 62 that is fastened to the second carriage 70. The blade motors 60, 62 may be, for example, induction or electric motors, known in the art.

The V-shaped arrangement formed by the first and second conveyor belts 30, 36 provides a stable moving platform for the workpieces being machined. The first and the second conveyor belts 30, 36 are positioned generally at 45° with respect to the ground surface. Thus, without the need for further supports, the cutting apparatus 10 utilizes gravity to hold the workpiece in a stable manner as the workpieces are moved by the conveyor belts 30, 36 past the blades 52, 54. The arrangement of the blades 52, 54 with respect to the conveyor belts 30, 36 also facilitates the height H and thickness T adjustments of the sides of the corner pieces to be cut. In one embodiment, the cutting apparatus 10 is positioned at a slight downward angle with respect to the ground surface as it extends from the front end 48 to the rear end 50. In this manner, water run-off within the channel 46 is facilitated. In one embodiment, the cutting apparatus 10 is angled downwardly 1 inch for every 15 feet in length.

It should be noted that although the cutting apparatus 10 of the present disclosure is described as being used for cutting corner pieces, in other uses, the cutting apparatus 10 may be used to cut flat workpieces (such as flat veneer). For example, by removing one of the cutting blades 52, 54 of the cutting apparatus and adjusting the location of the blade for a desired dimension, a flat workpiece may be cut. The V-shaped arrangement formed by the conveyor belts 30, 36 provides a stable support surface for flat workpieces as well.

As shown in the Figures, the V-shaped channel 46 formed by the first and second conveyor belts 30, 36 is covered by a removable cover 76 that is configured to protect against flying debris and water resulting from the corner cutting process. The cover 76 is fastened to plates 42, 44 extending between the conveyor rollers 32, 34, 38, 40 on both sides of the apparatus 10. The cover 76 defines an open front end 78 configured to receive the workpiece to be cut. Adjacent the front end 78 of the cover 76 is positioned a workpiece size sensor assembly 80, further details of which will be described below. The rear end 82 of the cover 76 includes a plurality of rubber flaps 84 that overlie a plurality of chains 86. As the corner piece approaches the rear end 82 of the cover 76, having been cut by the blades 52, 54, the corner piece moves through the rubber flaps 84 and the chains 86. The rubber flaps 84 are configured to control the water running out of the channel 46 and the chains 86 are configured to control flying debris from inside the cover 76. The cutting apparatus 10 is shown in FIGS. 8 and 9 with the cover 76 removed to illustrate the cutting blades 52, 54 therein.

Figure 10:
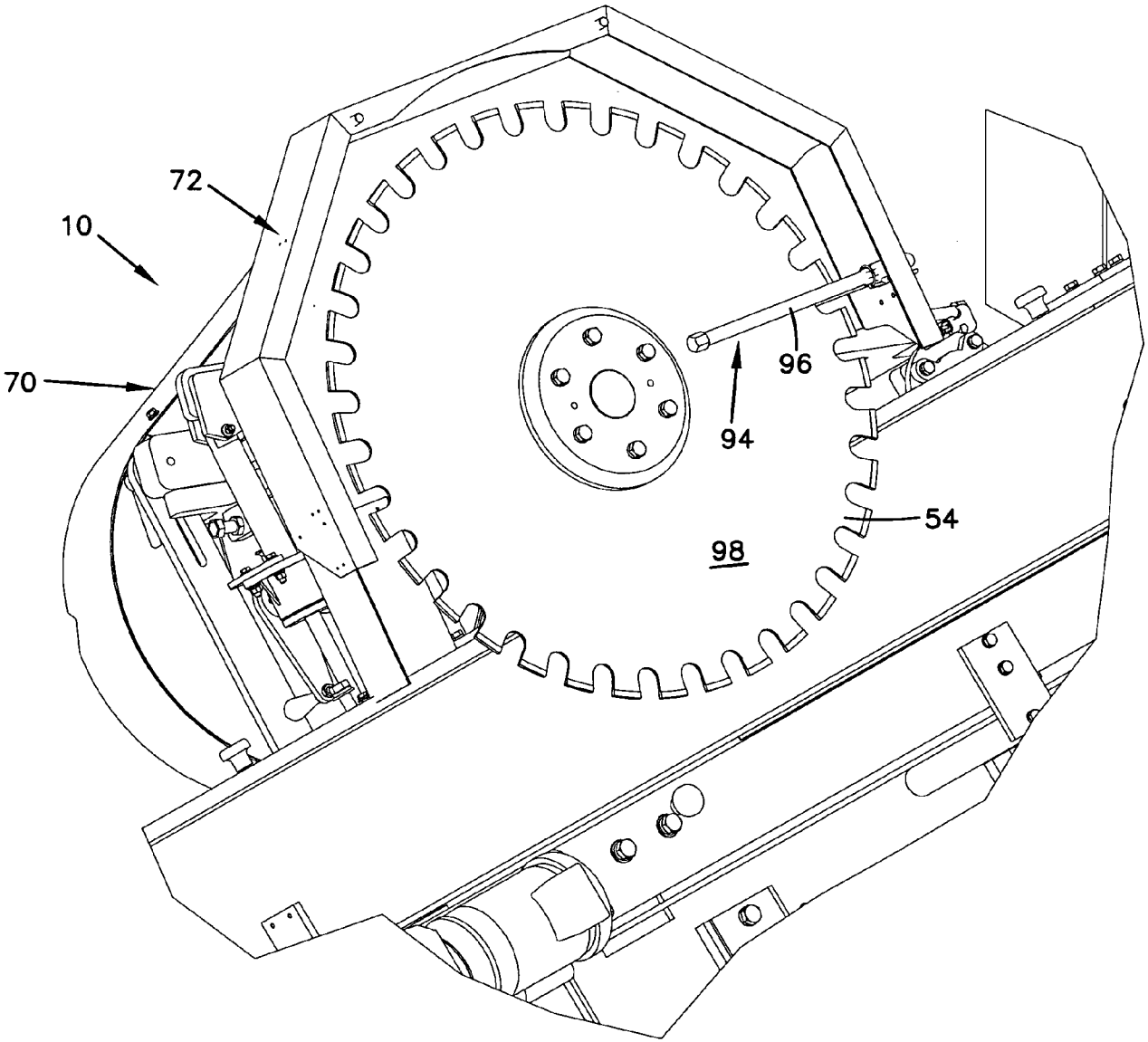
FIG. 10 illustrates a blade of the cutting apparatus of FIG. 1, with the blade cover removed.

Each of the first blade 52 and the second blade 54 are covered by a first blade cover 88 and a second blade cover 90, respectively. Each of the blade covers 88, 90 are removably mounted to the blade assemblies 68, 72 by rubber latches 92. In FIG. 10, one of the blades 52, 54 is illustrated with its blade cover removed. Although blade covers 88, 90 are not necessary for the operation of the cutting apparatus 10, they reduce the amount of dust and water released into the local atmosphere. Blade covers 88, 90 may also act as safety features and may protect operators from coming into contact with the spinning blades.

In the depicted embodiment, each of the blades 52, 54 is water-cooled. In other embodiments, wherein certain types of materials may be cut dry, the blades 52, 54 may be run dry.

As shown in FIG. 10, a pair of water forks 94 mounted on the blade assembly may provide water to the blades 52, 54. The water forks 94, as depicted, include pipes 96 extending parallel to the blade surfaces 98. The pipes 96 extend radially with respect to the blade and are positioned on both sides of the blade. Water forks such as the depicted water fork 94 are generally known in the art and are configured to shoot water to the surfaces 98 of the blades 52, 54 to prevent glazing of the blade and to help carrying debris out of the channel 46. The water also helps in reducing the amount of dust released into the local atmosphere, possibly reducing dust-related health risks (such as silicosis) posed to operators of the cutting apparatus 10. In the depicted embodiment, water is supplied to the water forks 94 via a piping system 100 carrying water from an external water source. The plumbing of the water can be configured in a number of different variations, as known in the art, and, is not discussed in further detail herein.

Figure 1:
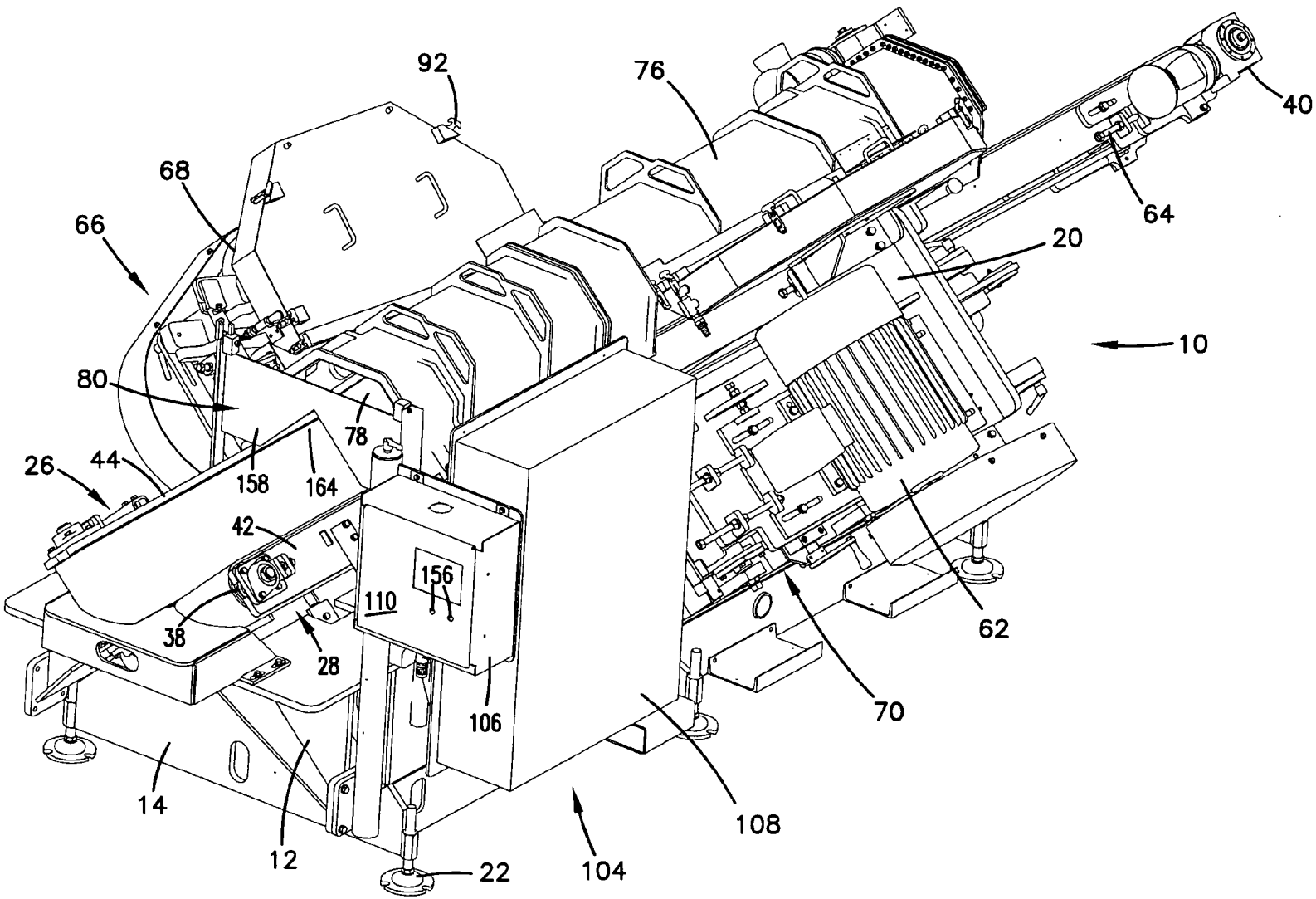
FIG. 1 is a front, right perspective view of a cutting apparatus having features that are examples of inventive aspects in accordance with the principles of the present disclosure.
Figure 2:
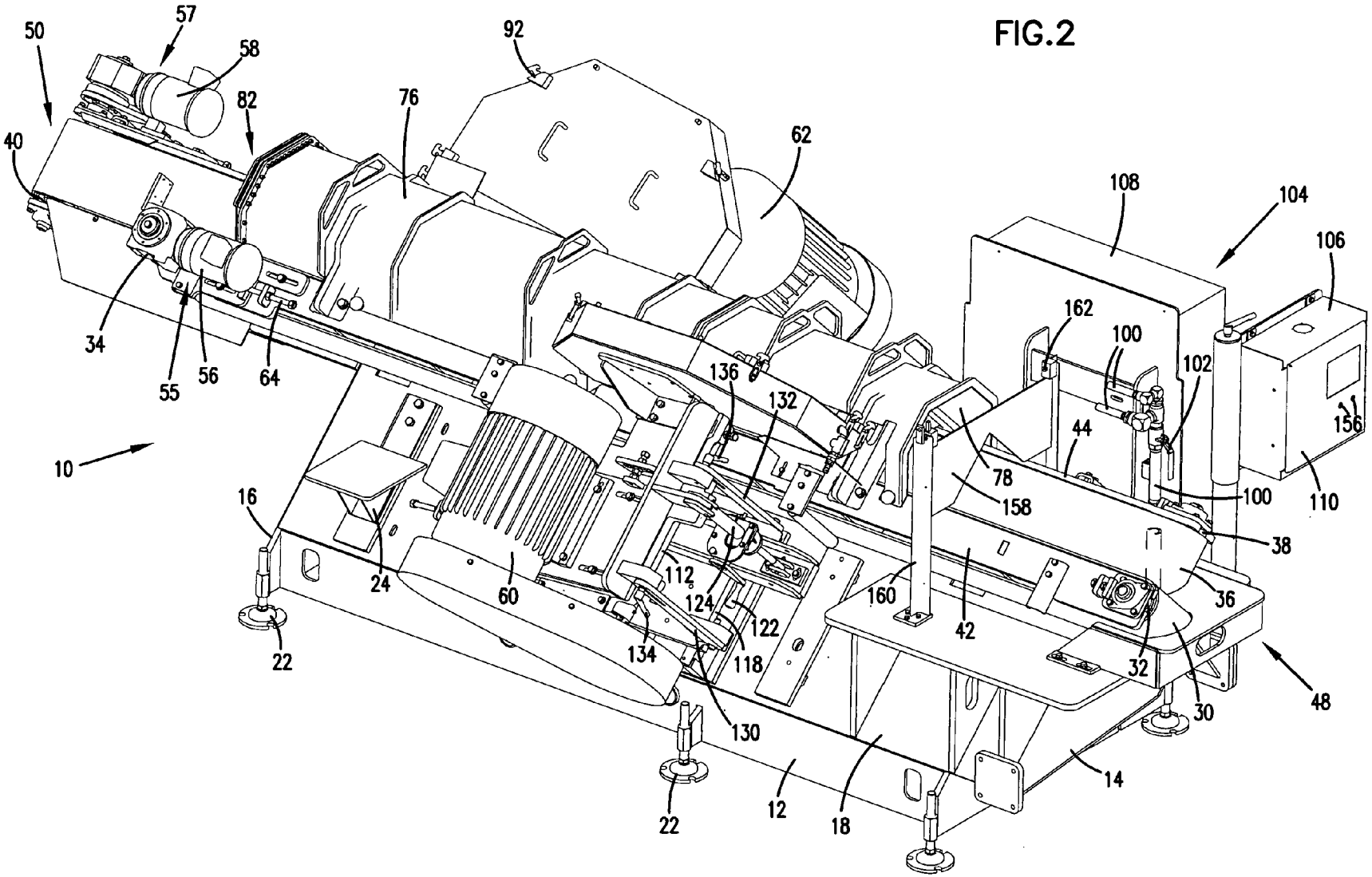
FIG. 2 is a front, left perspective view of the cutting apparatus of FIG. 1.

In the depicted embodiment, the cutting apparatus 10 includes a water flow shut-off valve 102 that may be used to completely shut-off the water flow to the blades 52, 54. The valve 102 is illustrated in FIG. 2. In one embodiment, the cutting apparatus 10 may also include a water flow sensor (not shown). A water flow sensor is configured to sense whether water is being supplied to the cutting apparatus 10. If the sensor determines that water flow has been cut-off, it communicates with a control system 104 of the cutting apparatus 10 to automatically shut off the conveyor and blade motors to prevent damage to the blades 52, 54. A number of parameters relating to the operation of the water flow sensor can be adjusted. For example, in one embodiment, the amount of time it takes for the motors to shut off after a lack of water flow has been detected can be adjusted. For example, in certain situations, it might be undesirable to shut off the cutting operation if a short blockage of waterflow (e.g., one lasting one or two seconds) occurs.

As noted above, the operation of the cutting apparatus 10 is controllable via the control system 104. The control system 104 includes a control station 106 located adjacent the front end 48 of the cutting apparatus 10. The control station 106 is operatively coupled to a control cabinet 108 of the control system 104 located at the side of the cutting apparatus 10. The control cabinet 108 may house a variety of sensors that are in electronic communication with the control station 106. The control station 106 includes an HMI (human machine interface) screen 110. The HMI screen may also be referred to herein as the control panel 110. Via the HMI screen 110, the operators of the cutting apparatus 10 are able to adjust a number of different parameters related to the cutting operation, as will be described in further detail below.

Now referring to FIGS. 2 and 5-7, as described previously, each of the first and second carriages 66, 70 are movable with respect to each of the conveyor belts 30, 36 to adjust the thickness T and the height H of the sides of the corner piece to be cut. The height and thickness adjustment of a side of a corner piece will be described in reference to the first blade assembly 68, it being understood that similar adjustments can be made with respect to the second blade assembly 72 for sizing the other, perpendicular side of the corner piece.

The first blade 52 and the first blade motor 60 are mounted on a pivot plate 112. As will be discussed in further detail below, the first blade 52 is fixedly mounted to the pivot plate 112 and the first blade motor 60 is slidably mounted to the pivot plate 112. The pivot plate 112 includes a front end 114 and a rear end 116. The pivot plate 112 is pivotally coupled to a base plate 118 and pivots about a pivot point 120 adjacent the rear end 116. The base plate 118 is fastened to the longitudinal plate 18 of the frame 12. The pivot plate 112 is configured to pivot with respect to the base plate 118 to move the first blade 52 toward and away from the second conveyor belt 36 for a height adjustment of one side of the corner piece. The movement of the plate 112 is accomplished by a height adjustment lever 122 that is operated manually. The height adjustment lever 122 is operatively coupled to an actuator 124 for pivotally moving the pivot plate 112 with respect to the base plate 118. In one embodiment, the actuator 124 may be a worm-gear drive screw jack. The actuator 124 extends between the base plate 118 and the pivot plate 112 and is attached to both. The height adjustment lever 122 is rotated manually to adjust the height of the blade 52 with respect to the second conveyor belt 36. The height adjustment lever 122 includes a lockable pin 126 for locking the blade 52 in place once the adjustment is finished. Once the lockable pin 126 is pushed in, it prevents turning of the height adjustment lever 122. The use of a hand turned adjustment lever 122 in combination with an actuator 124 allows the height H to be adjusted at an infinite number of points within a given range.

The first blade assembly 68 also includes a pivot plate locking mechanism 128 adjacent the front end 114. The pivot plate locking mechanism 128 includes a first linkage 130 and a second linkage 132 that movably couple the pivot plate 112 to the base plate 118. Once the pivotal adjustment is done, a first pivot plate locking lever 134 locks the pivot plate 112 along the first linkage 130 and a second pivot plate locking lever 136 locks the pivot plate 112 along the second linkage 132.

As shown in FIGS. 7 and 9, the base plate 118 includes a reinforcement plate 138 coupled thereto. The reinforcement plate 138 extends upwardly and includes a contact portion 140. The pivot plate 112 also includes a reinforcement plate 142 coupled thereto. The reinforcement plate 142 of the pivot plate 112 extends downwardly and includes a contact portion 144 that is configured to make contact with and slide along the contact portion 140 of the reinforcement plate 138 of the base plate 118. In one embodiment, the contact portions 140, 144 may be formed from a polymer material to reduce the amount of the friction therebetween. The reinforcement plates 138, 142 provide extra support to the movable coupling between the base plate 118 and the pivot plate 112.

For a thickness adjustment of a side of the corner piece to be cut, the first blade 52 is also movable toward and away from the first conveyor belt 30. For the thickness adjustment, the entire first blade assembly 68 including the base plate 118 and the pivot plate 112 are moved with respect to the longitudinal plate 18 of the frame 12 of the cutting apparatus 10. The movement is accomplished by manually turning a screw 146 that moves the carriage 66 with respect to the frame 12. The hand powered screw 146 is operated by a thickness adjustment lever 148. The thickness adjustment lever 148 includes a lockable pin 150 for locking the blade 52 in place once the thickness adjustment is finished. As in the height adjustment lever 122, once the lockable pin 150 is pushed in, it prevents turning of the thickness adjustment lever 148. The use of a hand powered screw 146 allows the thickness T to be adjusted at an infinite number of points within a given range.

As noted above, the second blade assembly 72 includes similar structures for performing adjustments to the perpendicular side of the corner piece to be cut.

Figure 3:
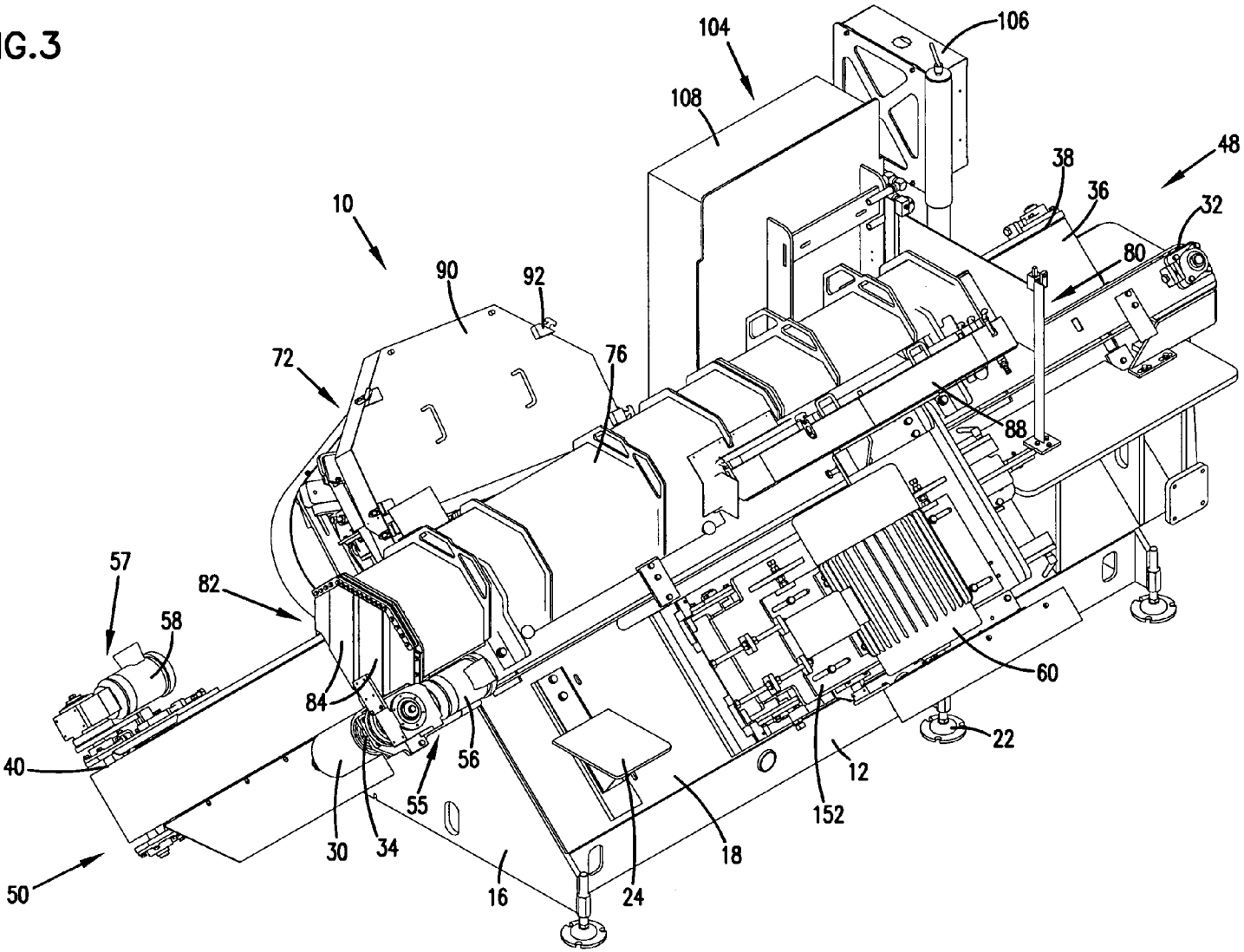
FIG. 3 is a rear, left perspective view of the cutting apparatus of FIG. 1.

Each of the blade motors 60, 62 are coupled to the blades 52, 54 via a belt (not shown). The tension of the belts between the motors 60, 62 and the blades 52, 54 can be adjusted by moving the motors 60, 62 with respect to the blades 52, 54. The motors 60, 62 are mounted on the carriages 66, 70 via motor plates 152 that are slidably movable with respect to the pivot plates 112. The blades 52, 54 are fixedly mounted to the pivot plates 112. Referring to FIG. 3, the movement of the motors 60, 62 with respect to the blades 52, 54 is accomplished by manually turning belt tension adjustment screws 154 that move the motors 60, 62 with respect to the blades 52, 54. The tension of the belts between the motors 60, 62 and the blades 52, 54 may depend on the material being cut and may be adjusted accordingly. The use of screws 154 allows the tension to be adjusted at an infinite number of points within a given range.

The cutting apparatus 10 may be run in manual mode or an automatic (auto-cycle) mode. Manual mode, as used herein, refers to the cutting operation wherein the speed of the conveyor belts 30, 36 are not generally adjusted based on the load on the blade motors 60, 62, but are run at a preset given speed. The automatic mode of the cutting apparatus 10, as used herein, refers a cutting operation that uses load-adjusted speed control of the conveyor belts 30, 36. As will be described further below, the manual mode may not be purely manual and may include certain operative features of the automatic mode to prevent damage to the cutting apparatus 10.

Regarding the automatic mode, according to one embodiment, the control cabinet 108 of the cutting apparatus includes an amp meter (not shown) associated with each of the blade motors 60, 62 that is in electronic communication with each blade motor 60, 62. The amp meters sense the amount of current drawn by each blade motor 60, 62 during the cutting operation. The load on each of the motors 60, 62 (i.e., the amperage or current drawn by each of the motors) is sensed at the same time and during the entire time of the cutting operation. The speed of the conveyor belts 30, 36 is adjusted according to the maximum current being drawn by one of the motors 60, 62 such that whichever blade motor is drawing more amps controls the conveyor speed. In one embodiment, the speed of the conveyor belts 30, 36 is adjusted in an inverse relation to the amount of current being drawn by the blade motors 60, 62. As the maximum current being drawn by one of the motors 60, 62 increases, the speed of the conveyor belts 30, 36 decreases.

A target amp draw can be set via the control station 106 along with the speed of the conveyor belts 30, 36. The speed of the conveyor belts 30, 36 and the speed of the blades 52, 54 may be varied for different types of materials being cut. For example, in one embodiment, for cutting lime stone, the speed of the conveyor belts may be set at about 5-8 ft/min. For cutting granite, the speed of the conveyor belts may be set at about 0.5-1 ft/min. In addition to target speeds, a maximum speed for the conveyor belts 30, 36 may also be set.

How frequently the current draw is sensed by the amp meter can be adjusted. Once the target amp draw is exceed by either of the blade motors 60, 62, the speed of both of the conveyor belts 30, 36 are adjusted automatically in relation to the difference between the target amp draw and the maximum amp draw at a given point in time. The target amp draw can be adjusted via the control station 106. In addition, the window between the target amp draw and the amp draw at which the speed of the conveyor belts 30, 36 will be automatically adjusted can be set. Such a window may be used since it may not be desirable to adjust the speed of the conveyor belts 30, 36 any time the target amp draw is exceeded, even by a nominal amount.

The rate at which the speed of the conveyor belts 30, 36 is adjusted such that the amp draw returns back to the target amp draw can be adjusted. The rate adjustment may include adjustment of the step size in the reduction of the speed of the conveyor belts 30, 36 as well as adjustment of the timing between the step sizes in the reduction of the speed of the conveyor belts 30, 36.

It should be noted that the speed of the conveyor belts 30, 36 can be adjusted in both an upward direction and a downward direction. The window with respect to the target amp draw may be set for both increased draw or decreased draw and speed adjustments may be made to the conveyor belt motors 56, 58 in an inverse relationship in both directions. Load-based cutting operations, wherein the speed of a conveyor belt is adjusted inversely in relation to the current drawn by a blade motor, is generally known in the art. One example load-based system and the control operation thereof is described in detail in U.S. Pat. Nos. 7,056,188 and 7,121,920, the disclosures of which are incorporated herein by reference in their entirety.

In addition to the adjustments mentioned above, an overload period can be set such that if the window above or below the target amp draw is exceeded for a given period of time, the blade motors 60, 62 and the conveyor motors 56, 58 may be shut off. The overload period or the amount of time it takes before the motors are shut off can be varied. In this manner, if the blade motors 60, 62 are consistently taking too much load, both the conveyor motors 56, 58 and the blade motors 60, 62 will shut off before damage to the motors 60, 62 or damage or excessive wear on the blades 52, 54 can occur.

The speed of the blade motors 60, 62, thus, the amp draw, can be adjusted depending upon the type of stone or other material being cut. Certain stones require a higher rotational speed of the blades and a higher current draw than others. In certain embodiments, the cutting apparatus 10 may include electronic soft starts (not shown) so that the blades 52, 54 reach an operating speed gradually.

The HMI screen 110 of the control station 106 may include a number of buttons 156 relating to the operation of the cutting apparatus 10. For example, in one embodiment, the buttons 156 on the HMI screen 110 may include short-cut buttons. In one embodiment, the HMI screen 110 may include buttons to turn-on and turn-off the load adjusted, automatic mode of the cutting apparatus 10. Since the automatic mode may be a mode that is frequently used, it might be desirable to have short-cut turn-on and turn-off buttons associated with this mode of operation. For example, in one embodiment, the HMI screen 110 may include an "auto-cycle start" button, an "auto-cycle stop" button, and an "auto-cycle pause" button.

The HMI screen 110 may also include a main power button for turning on and off the cutting apparatus 10. The HMI screen 110 may also include an emergency stop (i.e., shut-off) button in case of emergencies. Emergency stop buttons may also be located elsewhere on the cutting apparatus 10 for easy access. One such location is adjacent the rear end 50 of the cutting apparatus 10 where the corner pieces are unloaded after being cut.

As discussed above, the manual mode of operation may still include certain features of the automatic mode for damage prevention. For example, in certain embodiments, even though the conveyor belts 30, 36 may be running at a given speed in the manual mode, if an overload condition (i.e., a condition wherein the amp draw window has been exceeded) is sensed on the blade motors 60, 62 for a given period of time, the speed of the conveyor belts 30, 36 may be reduced automatically. In the automatic mode, the speed of the conveyor belts 30, 36 would increase automatically after the overload condition ends. However, in the manual mode, the conveyor belts 30, 36, after an overload condition is sensed, may stay spinning at the reduced speed and may be manually increased in speed to the desired level.

As noted above, the cutting apparatus 10 may also include a number of sensors for improving the cutting operation and preventing damage to the cutting apparatus 10 or to the operators thereof. One of such sensors is the workpiece size sensor assembly 80 noted above. The workpiece size sensor assembly 80 is located adjacent the front end 78 of the cover 76. The workpiece size sensor assembly 80 includes a plate 158 that is pivotally coupled to a bracket 160 via a pivot hinge 162. The bracket 160 is fastened to the frame 12 of the cutting apparatus 10.

The workpiece size sensor plate 158 includes a V-shaped cutout 164. The V-shaped cutout 164 defines an upper limit for the size of a workpiece to be carried by the conveyor belts 30, 36. If a workpiece is too large (i.e., too high) and contacts the pivotally disposed plate 158, the plate 158 pivots with respect to the bracket 160 and trips a sensor (not shown). The sensor electronically communicates with the control system 104 to automatically shut off the conveyor and blade motors. Via the control station 106, a number of parameters relating to the operation of the workpiece size sensor assembly 80 can be adjusted. For example, in one embodiment, the amount of time it takes the workpiece size sensor to shut off the motors after having been tripped can be adjusted.

In one embodiment, the cutting apparatus 10 may include a blade rotation sensor (not shown). The blade rotation sensor is configured to sense whether the blades 52, 54 are spinning. Since the depicted embodiment of the cutting apparatus 10 includes blades 52, 54 that are belt driven, if a belt were to break, there would not be a convenient way to tell if the blades 52, 54 were still spinning without such a sensor. Such a sensor might prevent hazardous situations.

According to one example operation of the cutting apparatus 10, a plurality of stones or other work pieces may be loaded adjacent the front end 48 of the cutting apparatus 10. The first and the second conveyor belts 30, 36 being operated at the same speed, carry the workpieces through the cutting apparatus 10. If a workpiece passes the workpiece size sensor assembly 80 without tripping the sensor, it enters the open front end 78 defined by the channel cover 76 and proceeds toward the first blade 52. The first blade 52, having been previously adjusted at the correct height $H_1$ and thickness $T_1$ for one of the corner sides, cuts one side of the corner piece. The workpiece is then cut by the second blade 54 to form the perpendicular side of the corner piece.

During the automatic operation of the cutting apparatus 10, the current drawn by each of the blade motors 60, 62 is sensed by the amp meters electronically connected to the motor blades 52, 54. Based on the maximum current draw and the difference thereof between a target current draw set previously, the speed of the conveyor belts 30, 36 is adjusted automatically. In this manner, overloading of the blades 52, 54 and damage and excessive wear thereto can be limited.

In certain operations, a workpiece that contacts the blades 52, 54 may tend to tip over, away from the blades 52, 54. To limit the tipping of the workpiece, a plurality of workpieces can be loaded into the channel 46 in series, one behind another. Thus, a workpiece contacting the blade can be supported by a workpiece that is directly behind it and contacting it. A large sacrificial piece can be placed at the very end of the series to keep the last workpiece from tipping over.

Figure 11:
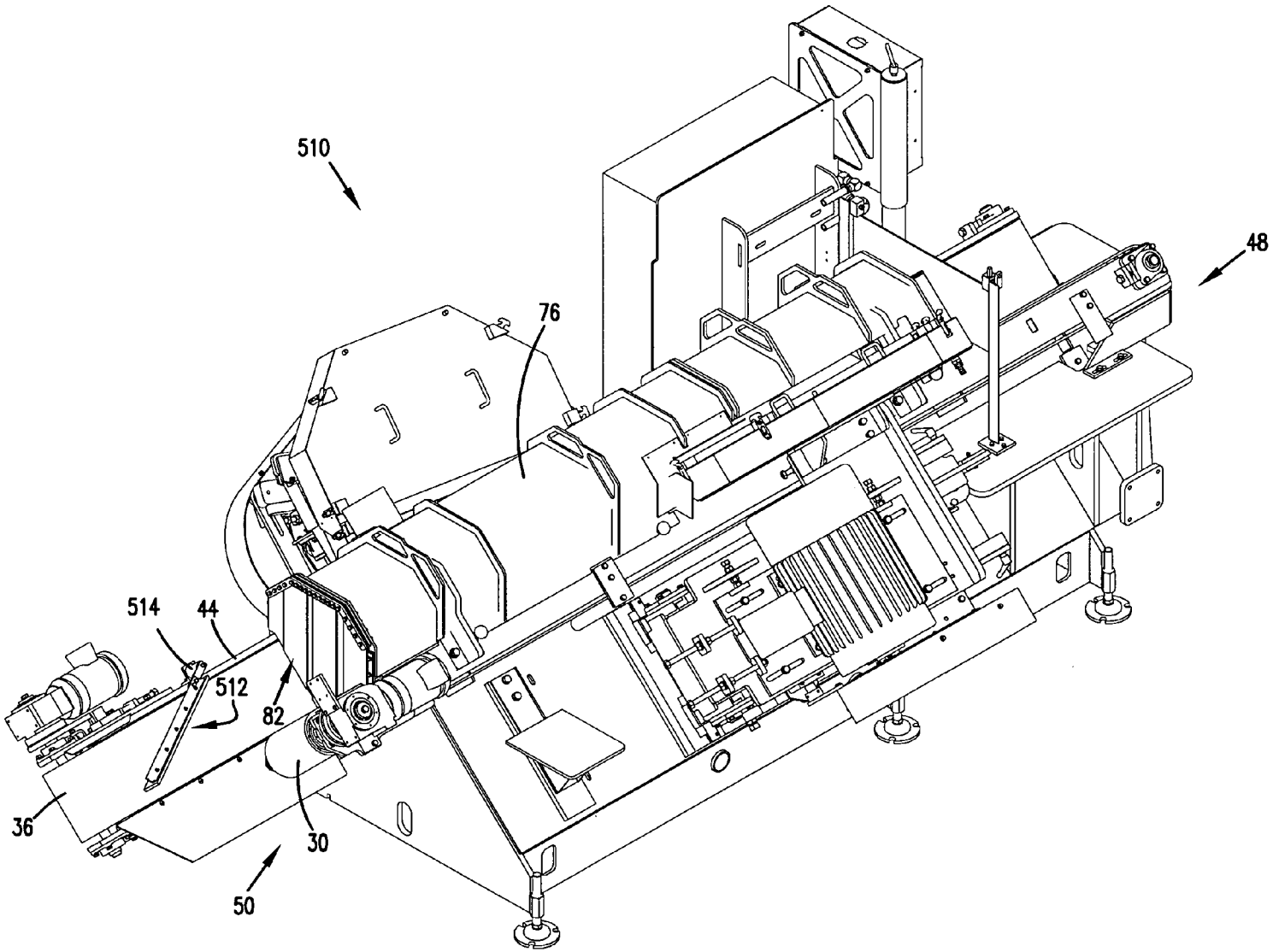
FIG. 11 is a rear, left perspective view of another cutting apparatus having features that are examples of inventive aspects in accordance with the principles of the present disclosure, the cutting apparatus including a workpiece deflection arm.
Figure 12:
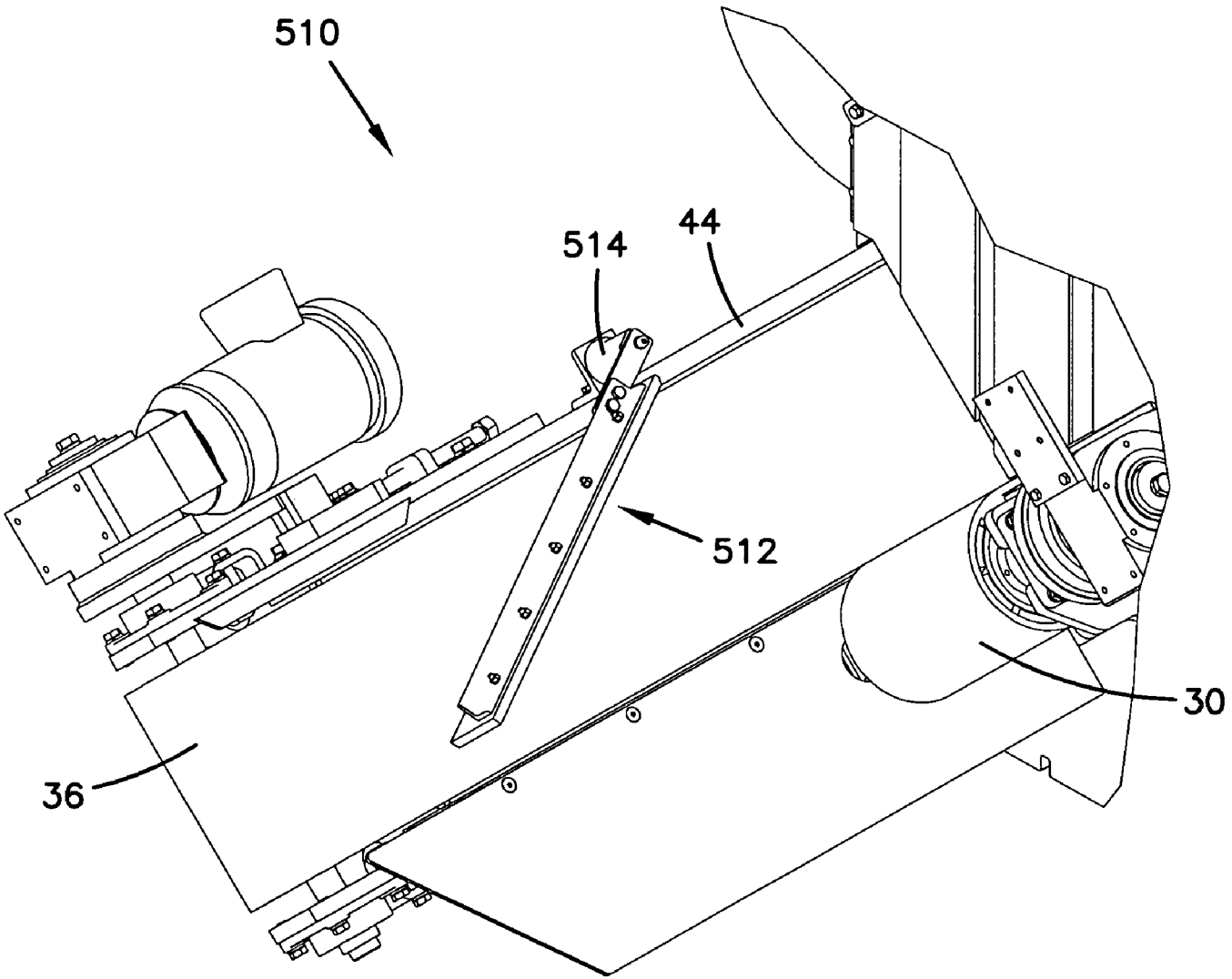
FIG. 12 illustrates a close-up view of the workpiece deflection arm of FIG. 11.

Referring now to FIGS. 11 and 12, a modified version of a cutting apparatus 510 having features that are examples of inventive aspects in accordance with the principles of the present disclosure is illustrated. The cutting apparatus 510 includes features similar to those of cutting apparatus 10 of FIGS. 1-10 except that cutting apparatus 510 also includes a workpiece deflection arm 512 at the rear, unloading end 50 of the cutting apparatus 510. In one embodiment, the workpiece deflection arm 512 is spring loaded. The workpiece deflection arm 512 is configured to deflect previously cut workpieces down off the conveyor belts 30, 36 as the workpieces approach the unloading end 50 of the cutting apparatus 510. During certain cutting operations, when certain workpieces get wet, they may stick to the surfaces of the conveyor belts 30, 36. The workpiece deflection arm 512 is configured to dislodge a stuck workpiece and deflect it off the conveyor belts after it has been cut.

As shown in FIGS. 11 and 12, the workpiece deflection arm 512 is pivotally coupled to one of the second conveyor plates 44 with a hinge structure 514. The workpiece deflection arm 512 extends at least partially over the second conveyor belt 36. As such, the workpiece deflection arm 512 is configured to make contact with a workpiece moving on the second conveyor belt 36. As discussed, in one embodiment, the workpiece deflection arm 512 may be a spring loaded arm that is biased away from the conveyor plate 44 to which it is attached. In such an embodiment, if a previously cut workpiece is large enough (e.g., in the longitudinal direction), such that one end contacts the deflection arm 512 before the other end leaves the rear end 82 of the cover 76, the deflection arm 512 can move out of the way against the bias of a spring of the deflection arm 512. Once the workpiece fully exits the rear end 82 of the cover 76, the workpiece may be dislodged and deflected off the conveyor belt 36 by the deflection arm 512. A close-up view of the workpiece deflection arm 512 is illustrated in FIG. 12.

The above specification provides examples of how certain inventive aspects may be put into practice. It will be appreciated that the inventive aspects can be practiced in other ways than those specifically shown and described herein without departing from the spirit and scope of the inventive aspects.

We claim:

1. A cutting apparatus comprising:

a frame including a first end and a second end;

a first conveyor operatively attached to the frame, the first conveyor configured to carry a workpiece from the first end of the frame to the second end of the frame, the first conveyor disposed at an angle of about 45 degrees to a ground surface supporting the cutting apparatus;

a second conveyor operatively attached to the frame, the second conveyor configured to carry a workpiece from the first end of the frame to the second end of the frame, the second conveyor disposed at an angle of about 45 degrees to the ground surface supporting the cutting apparatus, the second conveyor positioned perpendicularly to the first conveyor so as to form a V-shaped channel with the first conveyor;

a first cutting blade operatively attached to the frame and positioned generally parallel to the first conveyor;

a second cutting blade operatively attached to the frame and positioned generally parallel to the second conveyor;

a first blade motor and a second blade motor attached to the frame, the first and second blade motors configured to operate the first and second cutting blades, respectively; and a first conveyor motor assembly operatively coupled to the first conveyor and a second conveyor motor assembly operatively coupled to the second conveyor.

2. A cutting apparatus according to claim 1, wherein the first conveyor and the second conveyor are configured to operate at generally the same speed.

3. A cutting apparatus according to claim 2, further comprising a controller for adjusting the speed of the first and second conveyors based on an inverse relation to a load detected on at least one of the first and second blade motors.

4. A cutting apparatus according to claim 3, wherein the controller is configured to detect the load on both of the first and second blade motors at the same time and is configured to adjust the speed of the first and second conveyors based on the maximum detected load on the first and second blade motors.

5. A cutting apparatus according to claim 1, wherein the first cutting blade is movable toward and away from both the first and second conveyors.

6. A cutting apparatus according to claim 5, wherein the second cutting blade is movable toward and away from both the first and second conveyors.

7. A cutting apparatus according to claim 6, wherein both the first and second cutting blades are movable relative to both the first and second conveyors with hand-operated levers.

8. A cutting apparatus according to claim 1, wherein the first and second cutting blades are water-cooled.

9. A cutting apparatus according to claim 1, wherein the second conveyor extends farther back relative to the second end of the frame than the first conveyor.

10. A cutting apparatus according to claim 1, further comprising a workpiece size sensor located adjacent the first end of the frame, the workpiece size sensor configured to detect workpieces that are too large to be cut by the first and second blades.

11. A cutting apparatus according to claim 1, further comprising a workpiece deflection arm positioned adjacent the second end of the frame, the workpiece deflection arm configured to deflect the workpiece off the cutting apparatus after the workpiece has been cut by the first and second cutting blades.

12. A method of assembling a cutting apparatus for cutting a corner out of a workpiece, the method comprising;

providing a first conveyor configured to carry the workpiece;

providing a second conveyor configured to carry the workpiece;

providing a first conveyor motor assembly for operating the first conveyor;

providing a second conveyor motor assembly for operating the second conveyor;

positioning the first conveyor at an angle of about 45 degrees from a ground surface;

positioning the second conveyor at an angle of about 45 degrees from the ground surface;

positioning the first conveyor perpendicularly to the second conveyor so as to form a V-shaped arrangement therewith;

providing a first cutting blade configured to cut a first side of the corner out of the workpiece;

providing a second cutting blade configured to cut a second side of the corner out of the workpiece, the second side being perpendicular to the first side;

positioning the first cutting blade generally parallel to the first conveyor; and positioning the second cutting blade generally parallel to the second conveyor.

13. A method according to claim 12, wherein both the first and the second cutting blades are movable toward and away from both the first and second conveyors.

14. A method according to claim 12, further comprising providing a first blade motor for operating the first cutting blade and providing a second blade motor for operating the second cutting blade.

15. A method according to claim 12, further comprising providing a workpiece deflection arm for deflecting the workpiece off the cutting apparatus after the workpiece has been cut by the first and second cutting blades.

16. A cutting apparatus comprising:

a frame;

a conveyor arrangement for moving a stone workpiece relative to the frame in a longitudinal direction;

a first rotatable cutting blade operatively attached to the frame;

a second rotatable cutting blade operatively attached to the frame;

a workpiece deflection arm positioned to deflect the stone workpiece off the conveyor arrangement after the stone workpiece has been cut by the first and second rotatable cutting blades;

wherein the first rotatable cutting blade is positioned at an angle of about 45 degrees to a reference surface parallel to the longitudinal direction and the second rotatable cutting blade is positioned at an angle of about 135 degrees to the reference surface, the first rotatable cutting blade and the second rotatable cutting blade forming a V-shaped arrangement.

17. A cutting apparatus comprising:

a frame including a first end and a second end;

a first conveyor operatively attached to the frame, the first conveyor configured to carry a workpiece from the first end of the frame to the second end of the frame, the first conveyor disposed at an angle of about 45 degrees to a ground surface supporting the cutting apparatus;

a second conveyor operatively attached to the frame, the second conveyor configured to carry a workpiece from the first end of the frame to the second end of the frame, the second conveyor disposed at an angle of about 45 degrees to the ground surface supporting the cutting apparatus, the second conveyor positioned perpendicularly to the first conveyor so as to form a V-shaped channel with the first conveyor;

a cutting blade arrangement including a rotatable cutting blade operatively attached to the frame and positioned generally parallel to at least one of the first conveyor and the second conveyor; and a first conveyor motor operatively coupled to the first conveyor and a second conveyor motor operatively coupled to the second conveyor.

18. A cutting apparatus according to claim 17, further comprising a workpiece deflection arm positioned adjacent the second end of the frame, the workpiece deflection arm configured to deflect the workpiece off the cutting apparatus after the workpiece has been cut by the cutting blade arrangement.

19. A cutting apparatus comprising:

a frame including a first end and a second end;

a first conveyor operatively attached to the frame, the first conveyor configured to carry a workpiece from the first end of the frame to the second end of the frame, the first conveyor disposed at an angle of about 45 degrees to a ground surface supporting the cutting apparatus;

a second conveyor operatively attached to the frame, the second conveyor configured to carry a workpiece from the first end of the frame to the second end of the frame, the second conveyor disposed at an angle of about 45 degrees to the ground surface supporting the cutting apparatus, the second conveyor positioned perpendicularly to the first conveyor so as to form a V-shaped channel with the first conveyor;

a first cutting blade operatively attached to the frame and positioned generally parallel to the first conveyor; and a second cutting blade operatively attached to the frame and positioned generally parallel to the second conveyor;

wherein the first cutting blade is movable toward and away from both the first and second conveyors.

20. A cutting apparatus according to claim 19, wherein the second cutting blade is movable toward and away from both the first and second conveyors.

21. A cutting apparatus according to claim 20, wherein both the first and second cutting blades are movable relative to both the first and second conveyors with hand-operated levers.

22. A cutting apparatus comprising:

a frame including a first end and a second end;

a first conveyor operatively attached to the frame, the first conveyor configured to carry a workpiece from the first end of the frame to the second end of the frame, the first conveyor disposed at an angle of about 45 degrees to a ground surface supporting the cutting apparatus;

a second conveyor operatively attached to the frame, the second conveyor configured to carry a workpiece from the first end of the frame to the second end of the frame, the second conveyor disposed at an angle of about 45 degrees to the ground surface supporting the cutting apparatus, the second conveyor positioned perpendicularly to the first conveyor so as to form a V-shaped channel with the first conveyor and extends farther back relative to the second end of the frame than the first conveyor;

a first cutting blade operatively attached to the frame and positioned generally parallel to the first conveyor; and a second cutting blade operatively attached to the frame and positioned generally parallel to the second conveyor.

23. A cutting apparatus comprising:

a frame including a first end and a second end;

a first conveyor operatively attached to the frame, the first conveyor configured to carry a workpiece from the first end of the frame to the second end of the frame, the first conveyor disposed at an angle of about 45 degrees to a ground surface supporting the cutting apparatus;

a second conveyor operatively attached to the frame, the second conveyor configured to carry a workpiece from the first end of the frame to the second end of the frame, the second conveyor disposed at an angle of about 45 degrees to the ground surface supporting the cutting apparatus, the second conveyor positioned perpendicularly to the first conveyor so as to form a V-shaped channel with the first conveyor;

a first cutting blade operatively attached to the frame and positioned generally parallel to the first conveyor;

a second cutting blade operatively attached to the frame and positioned generally parallel to the second conveyor; and a workpiece size sensor located adjacent the first end of the frame, the workpiece size sensor configured to detect workpieces that are too large to be cut by the first and second blades.

24. A method of assembling a cutting apparatus for cutting a corner out of a workpiece, the method comprising;

providing a first conveyor configured to carry the workpiece;

providing a second conveyor configured to carry the workpiece;

positioning the first conveyor at an angle of about 45 degrees from a ground surface;

positioning the second conveyor at an angle of about 45 degrees from the ground surface;

positioning the first conveyor perpendicularly to the second conveyor so as to form a V-shaped arrangement therewith;

providing a first cutting blade configured to cut a first side of the corner out of the workpiece;

providing a second cutting blade configured to cut a second side of the corner out of the workpiece, the second side being perpendicular to the first side;

positioning the first cutting blade generally parallel to the first conveyor; and positioning the second cutting blade generally parallel to the second conveyor;

wherein both the first and the second cutting blades are movable toward and away from both the first and second conveyors.

25. A cutting apparatus comprising:

a frame including a first end and a second end;

a first conveyor operatively attached to the frame, the first conveyor configured to carry a workpiece from the first end of the frame to the second end of the frame, the first conveyor disposed at an angle of about 45 degrees to a ground surface supporting the cutting apparatus;

a second conveyor operatively attached to the frame, the second conveyor configured to carry a workpiece from the first end of the frame to the second end of the frame, the second conveyor disposed at an angle of about 45 degrees to the ground surface supporting the cutting apparatus, the second conveyor positioned perpendicularly to the first conveyor so as to form a V-shaped channel with the first conveyor;

a first cutting blade operatively attached to the frame and positioned generally parallel to the first conveyor;

a second cutting blade operatively attached to the frame and positioned generally parallel to the second conveyor; and a workpiece deflection arm positioned adjacent the second end of the frame, the workpiece deflection arm configured to deflect the workpiece off the cutting apparatus after the workpiece has been cut by the first and second cutting blades.

26. A method of assembling a cutting apparatus for cutting a corner out of a workpiece, the method comprising;

providing a first conveyor configured to carry the workpiece;

providing a second conveyor configured to carry the workpiece;

positioning the first conveyor at an angle of about 45 degrees from a ground surface;

positioning the second conveyor at an angle of about 45 degrees from the ground surface;

positioning the first conveyor perpendicularly to the second conveyor so as to form a V-shaped arrangement therewith;

providing a first cutting blade configured to cut a first side of the corner out of the workpiece;

providing a second cutting blade configured to cut a second side of the corner out of the workpiece, the second side being perpendicular to the first side;

positioning the first cutting blade generally parallel to the first conveyor;

positioning the second cutting blade generally parallel to the second conveyor; and providing a workpiece deflection arm for deflecting the workpiece off the cutting apparatus after the workpiece has been cut by the first and second cutting blades.

27. A cutting apparatus comprising:

a frame including a first end and a second end;

a first conveyor operatively attached to the frame, the first conveyor configured to carry a workpiece from the first end of the frame to the second end of the frame, the first conveyor disposed at an angle of about 45 degrees to a ground surface supporting the cutting apparatus;

a second conveyor operatively attached to the frame, the second conveyor configured to carry a workpiece from the first end of the frame to the second end of the frame, the second conveyor disposed at an angle of about 45 degrees to the ground surface supporting the cutting apparatus, the second conveyor positioned perpendicularly to the first conveyor so as to form a V-shaped channel with the first conveyor;

a cutting blade arrangement including a rotatable cutting blade operatively attached to the frame and positioned generally parallel to at least one of the first conveyor and the second conveyor; and a workpiece deflection arm positioned adjacent the second end of the frame, the workpiece deflection arm configured to deflect the workpiece off the cutting apparatus after the workpiece has been cut by the cutting blade arrangement.

* * * * *